US007482755B2

(12) United States Patent
Uemura et al.

(10) Patent No.: US 7,482,755 B2
(45) Date of Patent: Jan. 27, 2009

(54) PLASMA DISPLAY PANEL AND PLASMA DISPLAY DEVICE

(75) Inventors: Norihiro Uemura, Kokubunji (JP); Masayuki Shibata, Yokohama (JP); Hideki Harada, Miyazaki (JP); Yoshimi Kawanami, Miyazaki (JP); Osamu Toyoda, Kunitomi-cho (JP)

(73) Assignee: Fujitsu Hitachi Plasma Display Limited, Miyazaki-ken (JP)

( * ) Notice: Subject to any disclaimer, the term of this patent is extended or adjusted under 35 U.S.C. 154(b) by 394 days.

(21) Appl. No.: 11/392,793

(22) Filed: Mar. 30, 2006

(65) Prior Publication Data

US 2006/0232511 A1 Oct. 19, 2006

(30) Foreign Application Priority Data

Mar. 31, 2005 (JP) ..... 2005-104384

(51) Int. Cl.
*H01J 17/49* (2006.01)
*G09G 3/28* (2006.01)

(52) U.S. Cl. ..... 313/586; 313/582; 345/60; 315/169.4

(58) Field of Classification Search ..... None
See application file for complete search history.

(56) References Cited

U.S. PATENT DOCUMENTS

| | | | | |
|---|---|---|---|---|
| 5,640,068 | A | 6/1997 | Amemiya | |
| 6,452,333 | B1 | 9/2002 | Torisaki et al. | |
| 6,479,932 | B1 * | 11/2002 | Nunomura | 313/582 |
| 6,522,072 | B1 | 2/2003 | Yura et al. | |
| 7,199,522 | B2 * | 4/2007 | Jang et al. | 313/582 |
| 2002/0047591 | A1 | 4/2002 | Hirano et al. | |
| 2005/0017637 | A1 | 1/2005 | Kang et al. | |
| 2005/0067959 | A1 * | 3/2005 | Jang et al. | 313/582 |

FOREIGN PATENT DOCUMENTS

| | | |
|---|---|---|
| JP | 08-022772 | 1/1996 |
| JP | 2000-021304 | 1/2000 |
| JP | 2000-113828 | 4/2000 |
| JP | 2002-163990 | 6/2002 |
| JP | 2003-068217 | 3/2003 |
| JP | 2004-006426 | 1/2004 |
| KR | 2001-0053238 | 6/2001 |
| KR | 2003-0065187 | 8/2003 |
| KR | 10-2004-0068773 | 8/2004 |
| WO | WO 00/67283 | 11/2000 |

* cited by examiner

*Primary Examiner*—Ashok Patel
(74) *Attorney, Agent, or Firm*—Antonelli, Terry, Stout & Kraus, LLP.

(57) ABSTRACT

Conventionally, when a thickness of a dielectric layer is reduced without changing an electrode shape, a drive margin is reduced and stable driving cannot be performed. In a discharge cell, a display electrode comprises a projection extending in a column direction from an electrode body extending in a row direction, the projection forms a discharge gap together with an adjacent paired projection of the other display electrode, the projection includes a first projection and a second projection having two kinds of widths in a row direction, and when a ratio of widths of the second projection on the discharge gap side to the first projection on the electrode body side is assumed as Y and a thickness of the dielectric layer as X, $Y \leqq 0.2 \cdot X$, $X \leqq 20$ and $Y \geqq 0.5$ are satisfied.

2 Claims, 24 Drawing Sheets

X = 10 μm
Y = 3

X = 35 μm
Y = 3

X = 10 μm
Y = 1

PLASMA DISPLAY PANEL AND PLASMA DISPLAY DEVICE

CROSS-REFERENCE TO RELATED APPLICATION

The present application claims priority from Japanese Patent Application No. JP 2005-104384 filed on Mar. 31, 2005, the content of which is hereby incorporated by reference into this application.

TECHNICAL FIELD OF THE INVENTION

The present invention relates to a plasma display panel (PDP) and a plasma display device. More particularly, it relates to a plasma display panel and a plasma display device suitable for improving luminance, efficiency and image quality.

Conventionally, a plasma display device using an AC plasma display panel which performs the surface discharge (AC surface discharge PDP) has been put into practical use as a flat type image display device, and it has been widely used as an image display device for a personal computer or work station, a flat type wall-hanging TV, or a device for displaying advertisements and information. Furthermore, in recent years, it is desired to provide a plasma display panel and a plasma display device which can sufficiently secure a drive margin with high luminance and high emission efficiency and can be stably driven even at a low voltage, by improving an electrode shape of the plasma display panel.

BACKGROUND OF THE INVENTION

A plasma display device using an AC surface discharge PDP has already been put into practical use, in which all the pixels on a screen can simultaneously emit light in accordance with display data. The AC surface discharge PDP is a display device in which a large number of minute discharge spaces (discharge cells) sealed between two glass substrates are provided. Noble gas (discharge gas) filled in the discharge cells is discharged to form plasma and phosphors are excited by ultraviolet from the plasma. A display screen is formed from a visible light from each phosphor. Note that the method directly using the light emission from the plasma is also known.

FIG. 1 is an exploded perspective view showing a part of a structure of a plasma display panel (PDP). In the following description, components having the same function are denoted by the same reference symbols and repetitive description thereof will be omitted.

FIG. 1 shows a reflective PDP in which a front substrate 21 and a rear substrate 28 formed of glass substrates are bonded together and phosphor layers 32 for three primary colors such as red (R), green (G) and blue (B) are provided on the rear substrate 28.

The front substrate 21 has a pair of sustain discharge electrodes (also referred to as display electrodes) formed in parallel on a surface opposite to the rear substrate 28 with a certain distance therebetween. The pairs of sustain discharge electrodes are composed of transparent common electrodes (hereinafter, simply referred to as X electrodes) 22-1, 22-2, . . . and transparent independent electrodes (hereinafter, simply referred to as Y electrodes or scan electrodes) 23-1, 23-2, . . . .

The X electrodes 22-1, 22-2, . . . and the Y electrodes 23-1, 23-2, . . . are provided with opaque X bus electrodes 24-1, 24-2, . . . made of metal or the like for compensating the conductivity of the transparent electrodes and opaque Y bus electrodes 25-1, 25-2, . . . made of metal or the like for compensating the conductivity of the transparent electrodes, respectively, in an arrow direction D2 (row direction) in FIG. 2.

Note that the X electrodes 22-1, 22-2, . . . , the Y electrodes 23-1, 23-2, . . . , the X bus electrodes 24-1, 24-2, . . . and the Y bus electrodes 25-1, 25-2, . . . are insulated from discharge for AC drive. In other words, these electrodes are covered with a dielectric layer 26 generally made of low melting point glass (for example, lead glass: a relative dielectric constant $\in r$ is 12 to 14) and the dielectric layer 26 is covered with a protection film 27.

The rear substrate 28 has address electrodes (hereinafter, simply referred to as A electrodes) 29 which extend in a direction perpendicular to the X electrodes 22-1, 22-2, . . . and the Y electrodes 23-1, 23-2, . . . of the front substrate 21, on a surface opposite to the front substrate 21, and the A electrodes 29 are covered with a dielectric layer 30. The A electrodes 29 are provided so as to extend in an arrow direction D1 (column direction) of FIG. 2, and barrier ribs (ribs) 31 for separating the A electrodes 29 are provided on the dielectric layer 30 in order to prevent the expansion of the discharge (to define discharge regions). The phosphor layers 32 for emitting read, green, and blue lights are sequentially applied in a stripe shape to cover the grooves between the barrier ribs 31.

FIG. 2 is a cross-sectional view of the principal part of the plasma display panel viewed in the direction D2 in the exploded perspective view of FIG. 1, which shows one discharge cell which is the minimum unit of a pixel. In FIG. 2, a boundary between the discharge cells is a position shown by a dashed line.

In FIG. 2, a reference numeral 33 denotes a discharge space in which discharge gas for generating plasma 10 is filled. When a voltage is applied between the electrodes, the plasma 10 is generated by ionization of the discharge gas. FIG. 2 schematically shows how the plasma 10 is generated. Ultraviolet from the plasma 10 excites the phosphor 32 to emit light, and the light emission from the phosphor 32 transmits through the front substrate 21 and the light emission from the respective discharge cells form the display screen.

FIG. 3 is a plan view of the plasma display panel showing one example of an electrode shape viewed in a direction D3 in the exploded perspective view of FIG. 1. In FIG. 3, a portion surrounded by a dashed line indicates substantially one discharge cell CE.

The shape of transparent electrodes in FIG. 3 is of a so-called straight electrode. In addition, electrodes having the shape shown in FIG. 4 and FIG. 5 are also known for improving the performance of the PDP.

More specifically, as a surface discharge plasma display device capable of the display using the discharge light emission at relatively low power consumption even in a large display size, a device has been proposed, in which at least one row electrode of a pair of row electrodes has a body extending in a horizontal direction and a projection which projects from the body to the other row electrode in a vertical direction for each pixel cell and a length of the projection is 400 to 1000 μm (for example, Japanese Patent No. 3352821 (Japanese Patent Application Laid-Open Publication No. 08-022772) (Patent Document 1)).

Further, in order to manufacture a gas discharge display device having a uniform dielectric layer with a low relative dielectric constant, a device has been proposed, in which a layer which isotropically covers an underlying surface of a formed film is formed as a dielectric layer by the plasma vapor deposition, on a surface of a substrate structure after the X and Y electrodes have been disposed (for example, Japanese Patent No. 3481142 (Japanese Patent Application Laid-Open Publication No. 2000-021304) (Patent Document 2)).

Furthermore, in order to restrict the expansion of the discharge in a column direction to enhance the resolution, a device has been proposed, in which the X and Y electrodes are formed so as to have a shape composed of one band-shaped base extending throughout the full length of the screen in the row direction and a projection which projects to other adjacent row electrode from the base for each column (for example, Japanese Patent Application Laid-Open Publication No. 2000-113828 (Patent Document 3)).

In addition, in order to prevent decrease in luminance and erroneous discharge in the discharge cells to achieve the high definition, a device has also been proposed, in which the respective X and Y electrodes constituting the row electrode pair have transparent electrodes which project toward the other respective paired row electrodes from the bus electrodes extending in the row direction for each discharge cell and are opposite to each other via a predetermined discharge gap (for example, Japanese Patent No. 3334874 (Japanese Patent Application Laid-Open Publication No. 2002-163990) (Patent Document 4)).

Also, in order to manufacture a gas discharge display device having a uniform dielectric layer with a low relative dielectric constant, a device has been proposed, in which a layer which isotropically covers an underlying surface of a formed film and is made of silicon compound having a compression stress is formed as a dielectric layer by the plasma vapor deposition, on a surface of a substrate structure after the X and Y electrodes have been disposed (for example, Japanese Patent Application Laid-Open Publication No. 2004-006426 (Patent Document 5)).

SUMMARY OF THE INVENTION

FIG. 4 is a plan view of the plasma display panel showing a modified example of the electrode shape shown in FIG. 3, and FIG. 5 is a plan view of the plasma display panel showing another modified example of the electrode shape shown in FIG. 3.

As shown in FIG. 4 and FIG. 5, a conventional PDP has projections (62-1, 63-1; 62-2, 63-2 in FIG. 4 or 64-1, 65-1; 64-2, 65-2 in FIG. 5) extending in the column direction from the electrode bodies extending in the row direction (for example, 24-1, 25-1; 24-2, 25-2, in FIG. 4 or FIG. 5), which form discharge gaps DG together with the other projections adjacent (opposite) in the column direction (63-1, 62-1; 63-2, 62-2 in FIG. 4 or 65-1, 64-1; 65-2, 64-2 in FIG. 5).

Here, in the electrode shape shown in FIG. 4 and FIG. 5, an electrode area near the discharge gap DG is large (large in width) and an electrode area away from the discharge gap is small (small in width) in the electrodes having the projections. Hereinafter, the display electrodes (X or Y electrodes 7) shown in FIG. 4 are referred to as T-shaped electrodes, and the display electrodes shown in FIG. 5 are referred to as trapezoidal electrodes.

The T-shaped electrode shown in FIG. 4 and the trapezoidal electrode shown in FIG. 5 can decreases the firing voltage because the electrode area near the discharge gap DG is large, and can suppress a discharge current because the area of the entire electrode is small. Thus, these electrodes have the characteristics of reducing the firing voltage and reducing the discharge current.

Also, the dielectric layer 26 shown in FIG. 2 is one of materials constituting the PDP and has a function to insulate conductive electrodes from the discharge spaces for AC driving. A low melting point glass having a thickness of about 30 to 40 μm is generally employed for the dielectric layer 26. Furthermore, as described in the Patent Document 2 and Patent Document 5, the technology for reducing the thickness of a dielectric layer by the use of plasma vapor deposition or the like has been established.

However, in the conventional T-shaped electrode and trapezoidal electrode, if the thickness of the dielectric layer 26 is reduced in comparison with a conventional one, a problem that a drive margin cannot be obtained occurs. More specifically, when the thickness of the dielectric layer becomes smaller, the firing voltage decreases almost irrespective of the shape of the electrode, but the sustain discharge voltage is scarcely reduced. Consequently, the drive voltage cannot be reduced and the drive margin also becomes small, and stable driving cannot be performed.

Specifically, this problem will be conceptually (emphatically) described with reference to the PDP using the T-shaped electrodes shown in FIG. 4. For example, when a film thickness of the dielectric layer varies in each position of the panel at the time of manufacture, discharge DA1 is sustained only between tip ends of the opposed T-shaped electrodes (wide tip ends 71 in FIG. 6) in a certain discharge cell CE1, and discharge DA2 is sustained not only between the tip ends of the opposed T-shaped electrodes but also between the bus electrodes (between electrode bodies 70 in FIG. 6) in another discharge cell CE2. As described above, since the discharge cells which discharge at different intensities are present in the panel, the emission luminance differs depending on the positions.

In such a case, for example, a voltage of a sustain discharge pulse has to be set at a voltage at which discharge with the same intensity can be generated in all the discharge cells, that is, at a voltage at which discharge including the electrode bodies 70 of FIG. 6 can be generated. Therefore, a setting range thereof is limited and the drive margin decreases, and the stable driving cannot be performed. As a result, the drive voltage cannot be decreased, and since too much attention is paid to a variation in panel characteristics in the mass production, the PDP cannot be stably supplied.

Furthermore, since the drive voltage cannot be reduced, driving cannot be stably performed, and thus there occurs a problem that discharge gas for more effectively discharging ultraviolet and realizing high luminance and high emission efficiency cannot be used.

An object of the present invention is to provide a plasma display panel capable of sufficiently securing a drive margin and being stably driven at a low voltage. Further, another object of the present invention is to provide a plasma display device capable of achieving high luminance and high emission efficiency by using the plasma display panel capable of sufficiently securing a drive margin and being stably driven at a low voltage.

The first aspect of the present invention provides a plasma display panel comprising at least display electrodes, a dielectric layer covering the display electrodes, barrier ribs, and discharge spaces, in which discharge gas is filled in the discharge spaces to form a plurality of discharge cells, wherein, in each of the discharge cells, the display electrode has a projection extending in a column direction from an electrode body extending in a row direction, and the projection forms a discharge gap together with an adjacent paired projection of the other display electrode, the projection includes a first projection and a second projection having two kinds of widths in a row direction, and when a ratio of the widths of the second projection on the discharge gap side to the first projection on the electrode body side is defined as Y and a thickness of the dielectric layer as X, $Y \leqq 0.2 \cdot X$, $X \leqq 20$ and $Y \geqq 0.5$ are satisfied.

The second aspect of the present invention provides a plasma display panel comprising at least display electrodes, a dielectric layer covering the display electrodes, barrier ribs, and discharge spaces, in which discharge gas is filled in the discharge spaces, wherein, in each of the discharge cells, the display electrode has a projection extending in a column direction from an electrode body extending in a row direction, and the projection forms a discharge gap together with an adjacent paired projection of the other display electrode, the projection comprises a substantially trapezoidal part, and when a ratio of an upper base to a lower base of the trapezoidal part of the projection is defined as Y and a thickness of the dielectric layer as X, $Y \leqq (0.4 \cdot X)^{1/2}$, $X \leqq 20$ and $Y \geqq 0.5$ are satisfied.

The third aspect of the present invention provides a plasma display panel comprising at least display electrodes, a dielectric layer covering the display electrodes, barrier ribs, and discharge spaces, in which discharge gas is filled in the discharge spaces to form a plurality of discharge cells, wherein, in each of the discharge cells, the display electrode has a projection extending in a column direction from an electrode body extending in a row direction, and the projection forms a discharge gap together with an adjacent paired projection of the other display electrode, the display electrode has a reed shape, and the dielectric layer is made of a dielectric whose relative dielectric constant is 10 or lower, and a film thickness of the dielectric layer is 10 μm or smaller.

The fourth aspect of the present invention provides a plasma display panel comprising at least display electrodes, a dielectric layer covering the display electrodes, barrier ribs, and discharge spaces, in which discharge gas is filled in the discharge spaces to form a plurality of discharge cells, wherein, in each of the discharge cells, the display electrode has a projection extending in a column direction from an electrode body extending in a row direction, and the projection forms a discharge gap together with an adjacent paired projection of the other display electrode, in each of the discharge cells, when viewed from a front of the plasma display panel, an area of a region where discharge effectively expands is defined as an effective discharge area, in each of the discharge cells, an area of a region where discharge effectively expands and electrodes are present is defined as an effective electrode area, and when a ratio of the effective electrode area to the effective discharge area is assumed as Z and a relative dielectric constant of the dielectric layer is assumed as $\in r$, $3 \leqq \in r \leqq 14$, $0.15 \leqq Z \leqq 0.8$ and $-0.0614 \cdot \in r + 0.47 \leqq Z \leqq -0.0614 \cdot \in r + 1.46$ are satisfied.

The fifth aspect of the present invention provides a plasma display device comprising: a plasma display panel according to any one of claims 1 to 9; drivers for driving each of the discharge cells of the plasma display panel; and a control circuit for controlling the drivers, wherein the plasma display panel has the structure according to any one of the first to fourth aspects of the present invention.

According to the present invention, it is possible to provide a plasma display panel capable of sufficiently securing a drive margin and being stably driven at a low voltage. Further, according to the present invention, it is possible to provide a plasma display device capable of achieving high luminance and high emission efficiency by using the plasma display panel capable of sufficiently securing a drive margin and being stably driven at a low voltage.

BRIEF DESCRIPTIONS OF THE DRAWINGS

DESCRIPTIONS OF THE PREFERRED EMBODIMENTS

The present invention intends to provide a plasma display panel and a plasma display device with high luminance and high emission efficiency capable of sufficiently securing a drive margin and being stably driven at a low voltage, by appropriately setting various elements such as a thickness of a dielectric layer, an electrode shape, a composition of discharge gas, a relative dielectric constant of a dielectric, an effective discharge area, and an effective electrode area.

First, a principle structure of the present invention will be described before describing embodiments of the plasma display panel and plasma display device according to the present invention in detail.

Figure 6:
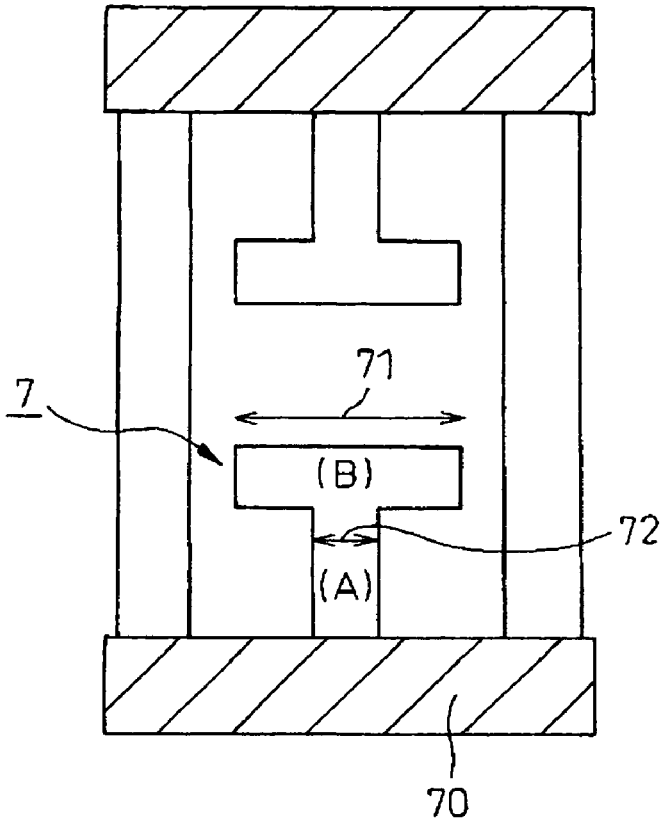
FIG. 6 is a diagram showing one example of an electrode shape of one cell in one embodiment of the plasma display panel according to the present invention.
Figure 7:
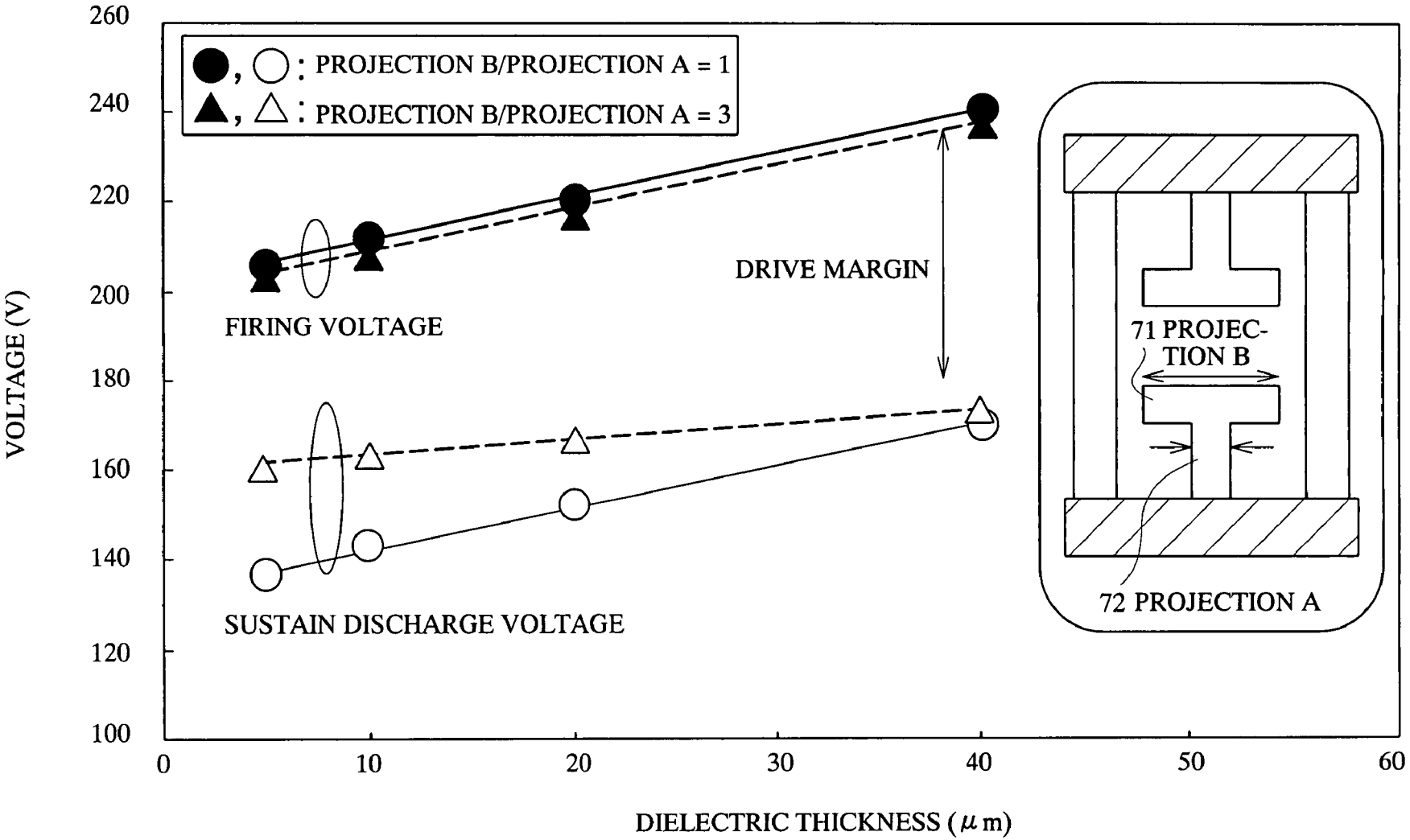
FIG. 7 is a diagram showing a measurement result of a firing voltage and a sustain discharge voltage when a thickness of a dielectric layer is changed in the plasma display panel to which the present invention is applied.

FIG. 6 is a diagram showing one example of an electrode shape of one cell in one embodiment of the plasma display panel according to the present invention, and FIG. 7 is a diagram showing a measurement result of a firing voltage and a sustain discharge voltage when a thickness of a dielectric layer 26 is changed in the plasma display panel to which the present invention is applied.

As shown in FIG. 6, a display electrode (X or Y electrode) 7 is composed of projections 71 and 72 having two kinds of widths (A and B) and extending from an electrode body 70 to an opposite display electrode side.

FIG. 7 shows the measurement results of the firing voltage and the sustain discharge voltage between the X electrode and the Y electrode for the thickness of the dielectric layer (dielectric thickness) of 40 μm, 20 μm, 10 μm and 5 μm, in the case of the electrode shape where a width of the projection B (71) is 150 μm and a width of the projection A(72) is 50 μm, that is, Y=projection B/projection A=150 μm/50 μm=3 when a ratio of the width of the projection 71 (projection B) on the discharge gap side to the width of the projection 72 (projection A) on the electrode body 70 side is assumed as Y, together with the case of Y=1 (the projection A and the projection B have the same width of 100 μm). Note that the display electrode (electrode described later in FIG. 10) in which the projection A and the projection B have the same width and Y=1 is referred to as a reed electrode.

Here, the firing voltage is a threshold voltage at which discharge when a wall charge in a cell is 0 V is generated, and the sustain discharge voltage is a threshold voltage at which discharge is stably sustained after the discharge generation. A difference between the firing voltage and the sustain discharge voltage corresponds to a drive margin between the X electrode and the Y electrode.

As shown in FIG. 7, in the display electrode of Y=3, the firing voltage decreases as the dielectric layer becomes thin, but the sustain discharge voltage does not decreases even when the dielectric layer becomes thin.

Meanwhile, in the display electrode in which the projection A and the projection B have the same width of 100 μm, that is, Y=1, the firing voltage decreases as the dielectric layer becomes thin similarly to the display electrode of Y=3, but the sustain discharge voltage decreases as the dielectric layer becomes thin unlike to the display electrode of Y=3.

From the above result, since the drive margin decreases as the dielectric layer becomes thin when Y=3, stable driving cannot be achieved. Further, if the projection A and the projection B are set to have the same width, that is, Y=1, the drive margin does not decrease even when the dielectric layer becomes thin, and the stable driving can be achieved.

The reason of the change in the drive margin in association with the thickness of the dielectric layer 26 based on the difference in the shape of the above-described display electrode has been examined, and the result thereof will be shown below.

Figure 8:
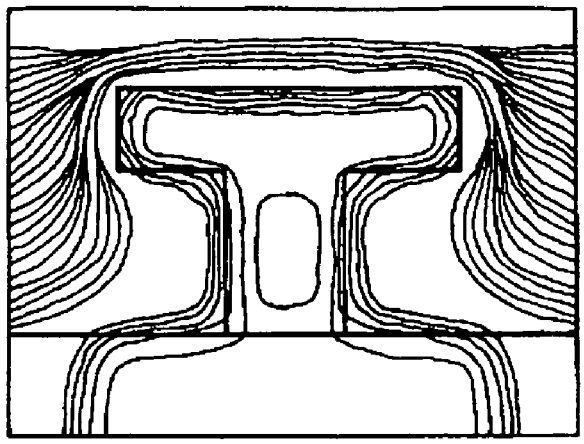
FIG. 8 is a diagram showing a simulation result of potential distribution on a protection film surface of a T-shaped electrode under the conditions of X=10 μm and Y=3.
Figure 9:
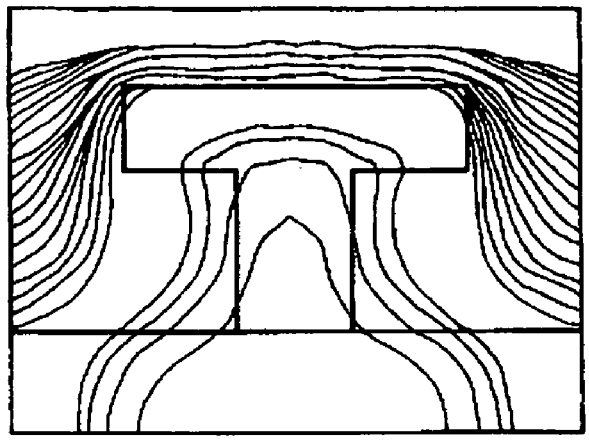
FIG. 9 is a diagram showing a simulation result of potential distribution on a protection film surface of a T-shaped electrode under the conditions of X=35 μm and Y=3.
Figure 10:
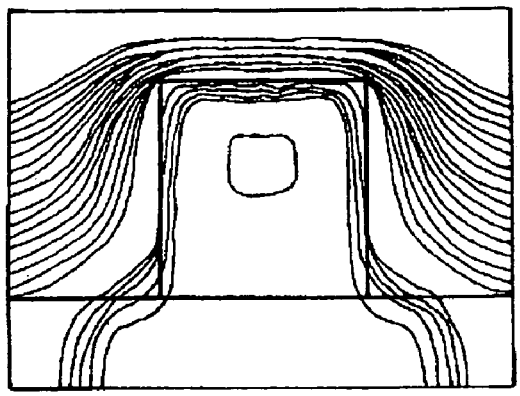
FIG. 10 is a diagram showing a simulation result of potential distribution on a protection film surface of a reed electrode under the conditions of X=10 μm and Y=1.

FIG. 8 is a diagram showing a simulation result of potential distribution on a protection film surface of the T-shaped electrode under the conditions of X=10 μm and Y=3, FIG. 9 is a diagram showing a simulation result of potential distribution on a protection film surface of the T-shaped electrode under the conditions of X=35 μm and Y=3, and FIG. 10 is a diagram showing a simulation result of potential distribution on a protection film surface of the reed electrode under the conditions of X=10 μm and Y=1. In this case, X indicates the thickness (μm) of the dielectric layer and Y indicates projection B (μm)/projection A (μm).

As shown in FIG. 8, in the T-shaped electrode of X=10 μm and Y=3, the potential distribution largely reflects the electrode shape. Since the wall charge formed on the protection film surface reflects the electrode shape, the sustain discharge becomes unstable, and the sustain discharge voltage is not decreased in comparison with the firing voltage.

Also, as shown in FIG. 9, in the T-shaped electrode in which the dielectric layer is thick (X=35 μm), since a potential on the protection film surface is spatially weakened, the sustain discharge can be stably performed.

Further, if the reed-shaped electrode (reed electrode) as shown in FIG. 10 is used when the dielectric layer is thin (X=10 μm), the sustain discharge can be stably performed. Here, when comparing the potential distribution of FIG. 9 with that of FIG. 10, they are remarkably similar to each other. Consequently, it can be expected that how discharge occurs is also similar.

As a result of the calculation using the simulations (calculations) of the potential distribution as functions of X and Y, it is concluded that the potential distribution capable of securing the drive margin can be obtained when the conditions of $Y \leqq 0.2 \cdot X$, $X \leqq 20$ and $Y \geqq 0.5$ are satisfied. This is illustrated in FIG. 11.

Figure 11:
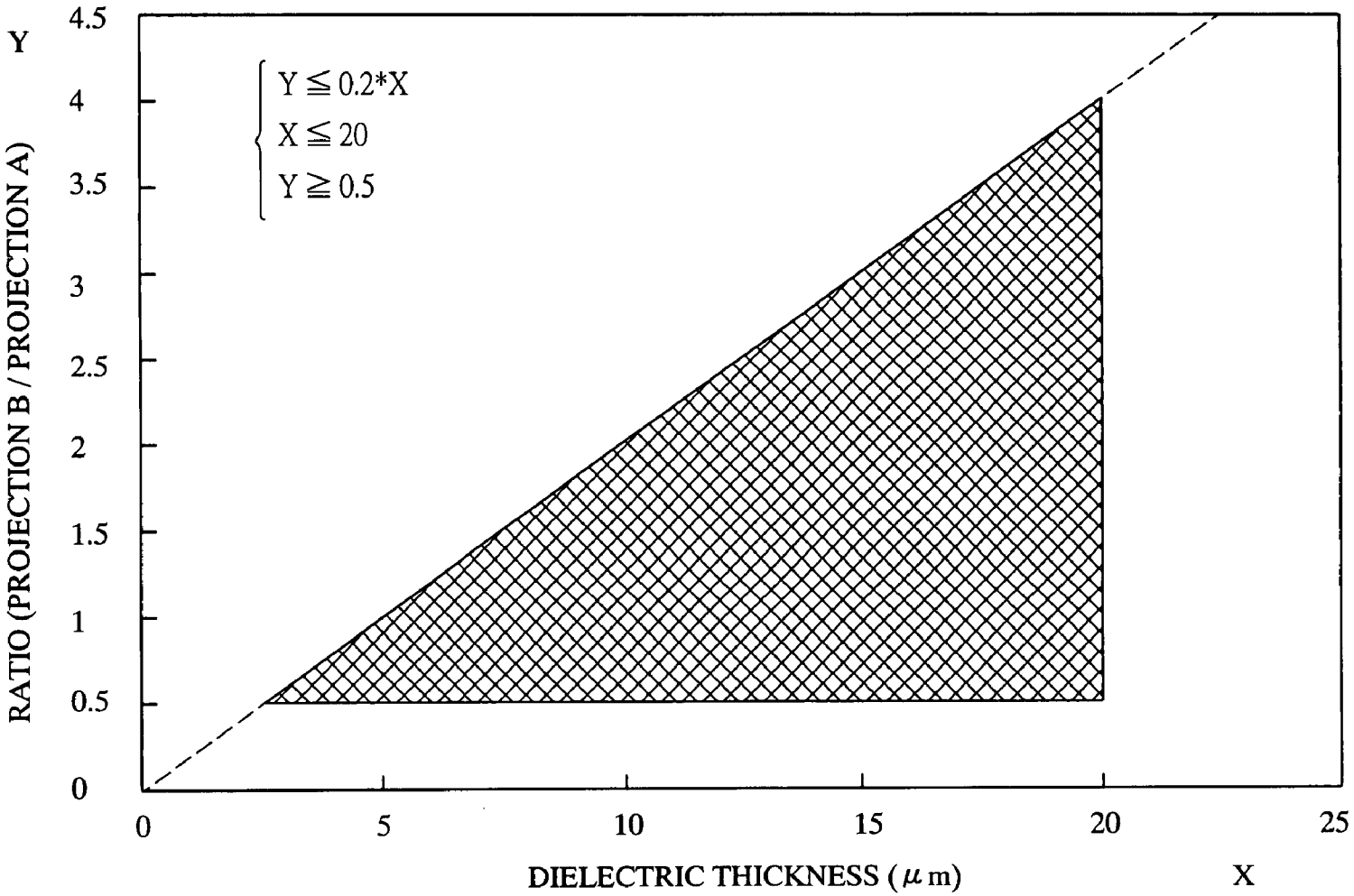
FIG. 11 is a diagram showing the condition required for electrodes in the plasma display panel according to the present invention.

More specifically, FIG. 11 is a diagram showing the condition required for the electrodes in the plasma display panel according to the present invention, and a cross-hatched region in FIG. 11 corresponds to the condition under which the PDP can be stably driven.

The embodiments of the plasma display panel and plasma display device according to the present invention will be described below in detail with reference to the accompanying drawings.

Embodiment

When a $SiO_2$ film (relative dielectric constant $\in r$ is 3 to 5) having a thickness of 10 μm (X=10) is used as the dielectric layer 26 for the reed electrode shown in FIG. 10, that is, the electrode in which the projection A and the projection B have the same width (Y=1), the condition shown in FIG. 11 is sufficiently satisfied, and the drive margin can be sufficiently secured. Note that, since the dielectric layer 26 is formed of a thin $SiO_2$ film having a thickness of 10 μm as described above, low voltage driving can be achieved when the luminance is the same, and high luminance display can be achieved when the same voltage is used for the driving.

Figure 12:
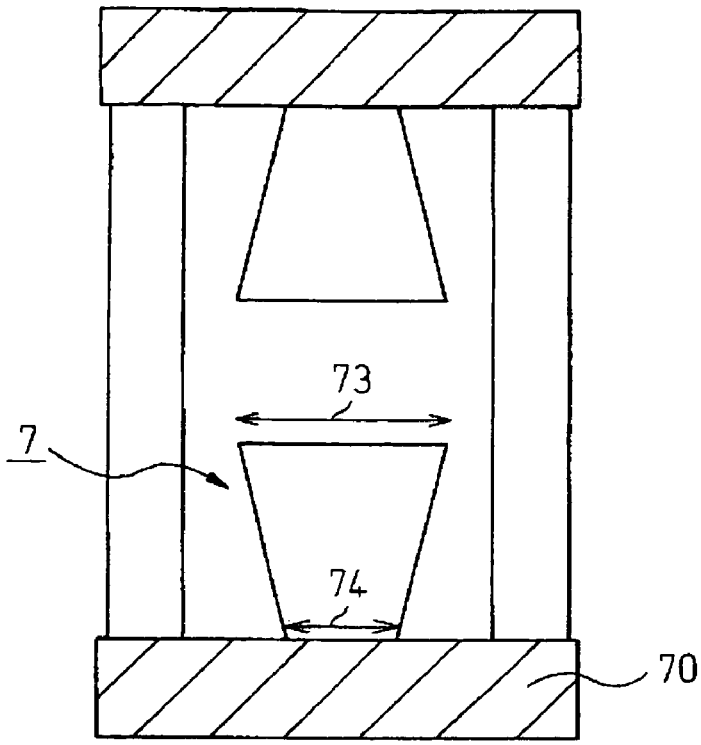
FIG. 12 is a diagram showing a modified example of a display electrode in the plasma display panel according to the present invention.

FIG. 12 is a diagram showing a modified example of the display electrode in the plasma display panel according to the present invention. As described above, the display electrode (X or Y electrode) can be formed as the reed electrode, and the projections thereof may be formed to be trapezoidal as shown in FIG. 12. In this case, trapezoid is a quadrangle having a pair of parallel opposite sides.

As shown in FIG. 12, when the projection is formed to be trapezoidal, attention is paid to a ratio of the widths of an upper base 73 and a lower base 74, and a ratio of the width 73 in the row direction on the discharge gap side, that is, the width of the upper base to the width 74 in the row direction on the electrode body 70 side, that is, the width of the lower base is used as Y which has been defined as projection B/projection A in the description above. More specifically, upper base (μm)/lower base (μm) is used as Y.

Figure 13:
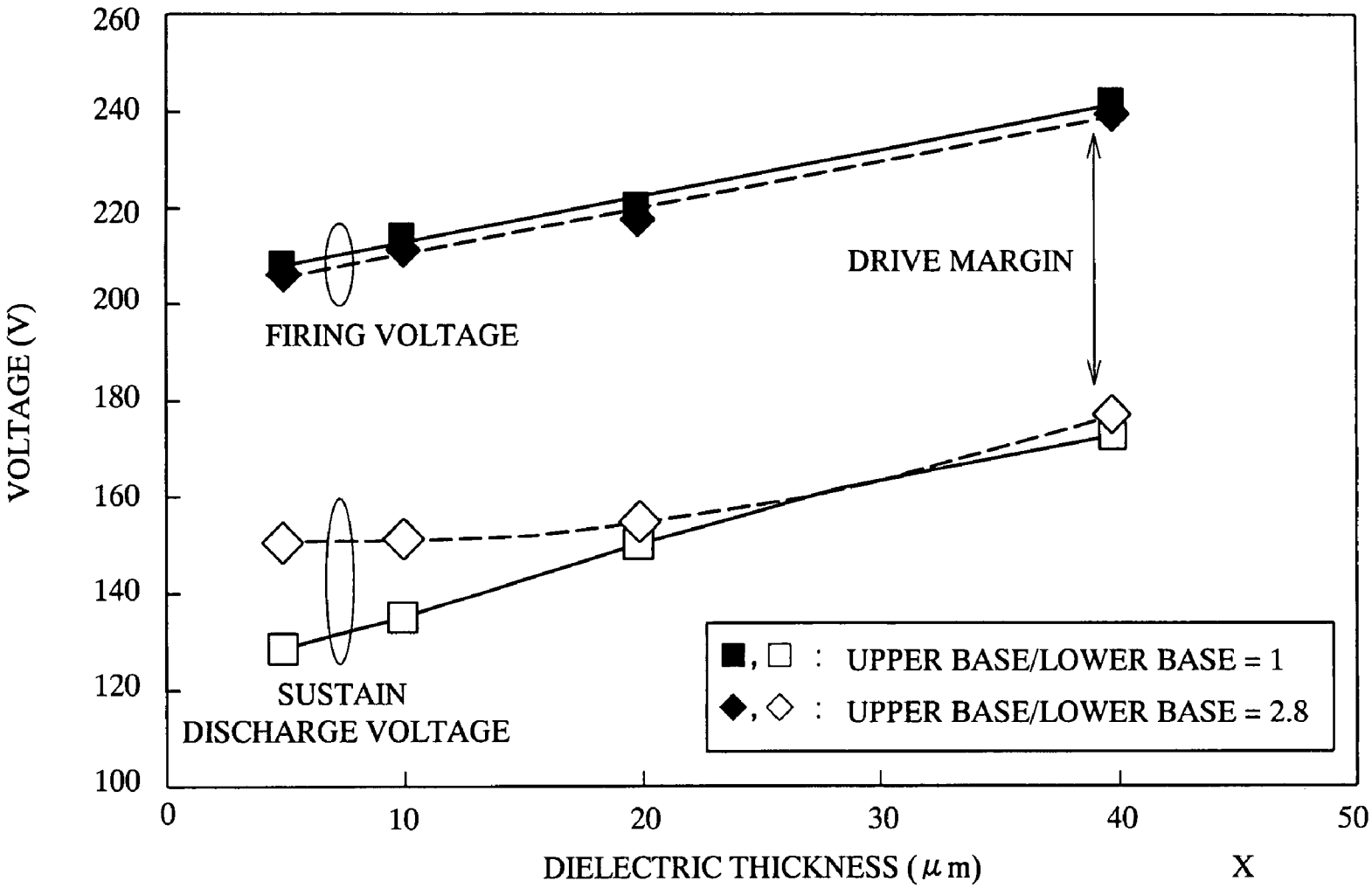
FIG. 13 is a diagram showing the result of the measurement in which the firing voltage and the sustain discharge voltage are measured while changing X and Y in the display electrode shown in FIG. 12.

Specifically, in the display electrode in which the width of the upper base is 140 μm and the width of the lower base is 50 μm, that is, Y=2.8, the firing voltage and the sustain discharge voltage between the X electrode and the Y electrode for the thickness of the dielectric layer of 40 μm, 20 μm, 10 μm and 5 μm are measured, and the measurement results are shown in FIG. 13.

In other words, FIG. 13 is a diagram showing the result of the measurement in which the firing voltage and the sustain discharge voltage are measured while changing X and Y in the display electrode shown in FIG. 12.

As shown in FIG. 13, when Y=2.8, the firing voltage decreases as the dielectric layer becomes thin, but the sustain discharge voltage scarcely decreases even when the dielectric layer becomes thin. Particularly in the region where the thickness of the dielectric layer is 20 μm or smaller, this tendency is strong. Note that, in the trapezoidal display electrode, a rate of the change relative to the thickness of the dielectric layer is not linear unlike to the case of the T-shaped electrode.

FIG. 13 also shows a result of the measurement of the firing voltage and the sustain discharge voltage in the electrode in which the upper base and the lower base have the same width of 120 μm, that is, in the electrode of Y=1.

As shown in FIG. 13, when Y=1, the firing voltage decreases as the dielectric layer becomes thin similarly to the case of Y=2.8, but the sustain discharge voltage decreases as the dielectric layer becomes thin unlike to the case of Y=2.8.

From the above result, the drive margin decreases as the dielectric layer becomes thin when Y=2.8, and the stable driving cannot be achieved. However, when the projection A and the projection B are designed to have the same length, that is, when the upper base and the lower base are designed to have the same width so as to set Y=1, the drive margin does not decrease even when the dielectric layer becomes thin. Therefore, the stable driving can be achieved.

The potential distribution on the protection film surface is calculated while changing the value of the thickness X of the dielectric layer and the ratio Y of the widths of the upper base and the lower base. According to the result of the calculation, since the potential on the protection film surface is spatially weakened also in the trapezoidal display electrode similarly to the T-shaped electrode when the dielectric layer is thick, the sustain discharge can be stably performed even in the electrode having a large value of Y. However, when the thickness of the dielectric layer is reduced, the sustain discharge cannot be stably performed if the electrode shape is not optimized.

From the description above, when the thickness of the dielectric layer 26 is defined as X (μm) and $Y \leqq (0.4 \cdot X)^{1/2}$, $X \leqq 20$, and $Y \geqq 0.5$ are satisfied, the potential distribution capable of securing the drive margin is obtained. This is illustrated on FIG. 11.

Figure 14:
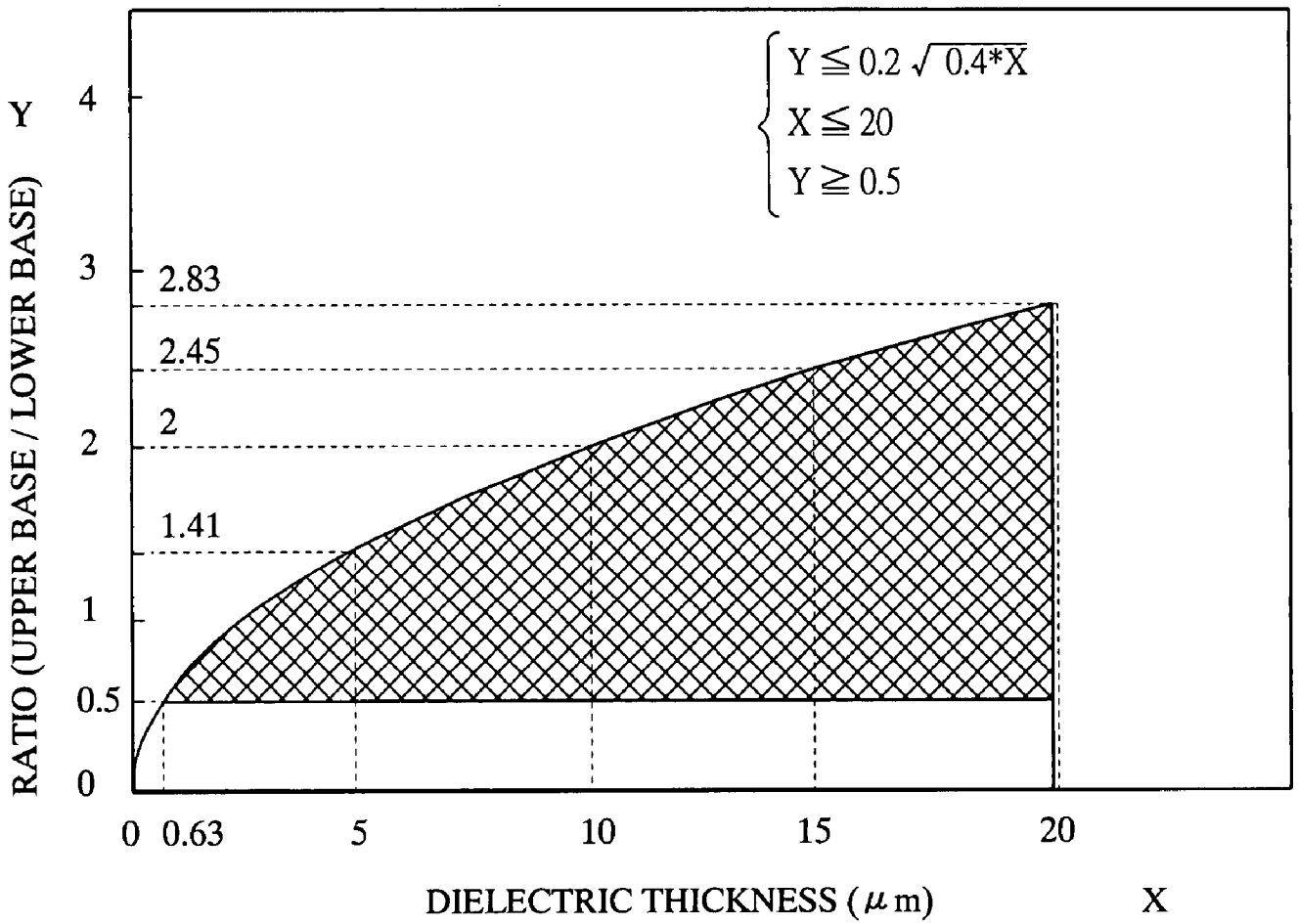
FIG. 14 is a diagram showing a relationship between X and Y in the display electrode shown in FIG. 12.

In other words, FIG. 14 is a diagram showing a relationship between X and Y in the display electrode shown in FIG. 12, and a cross-hatched region in FIG. 14 corresponds to the condition under which the PDP can be stably driven.

Figure 1:
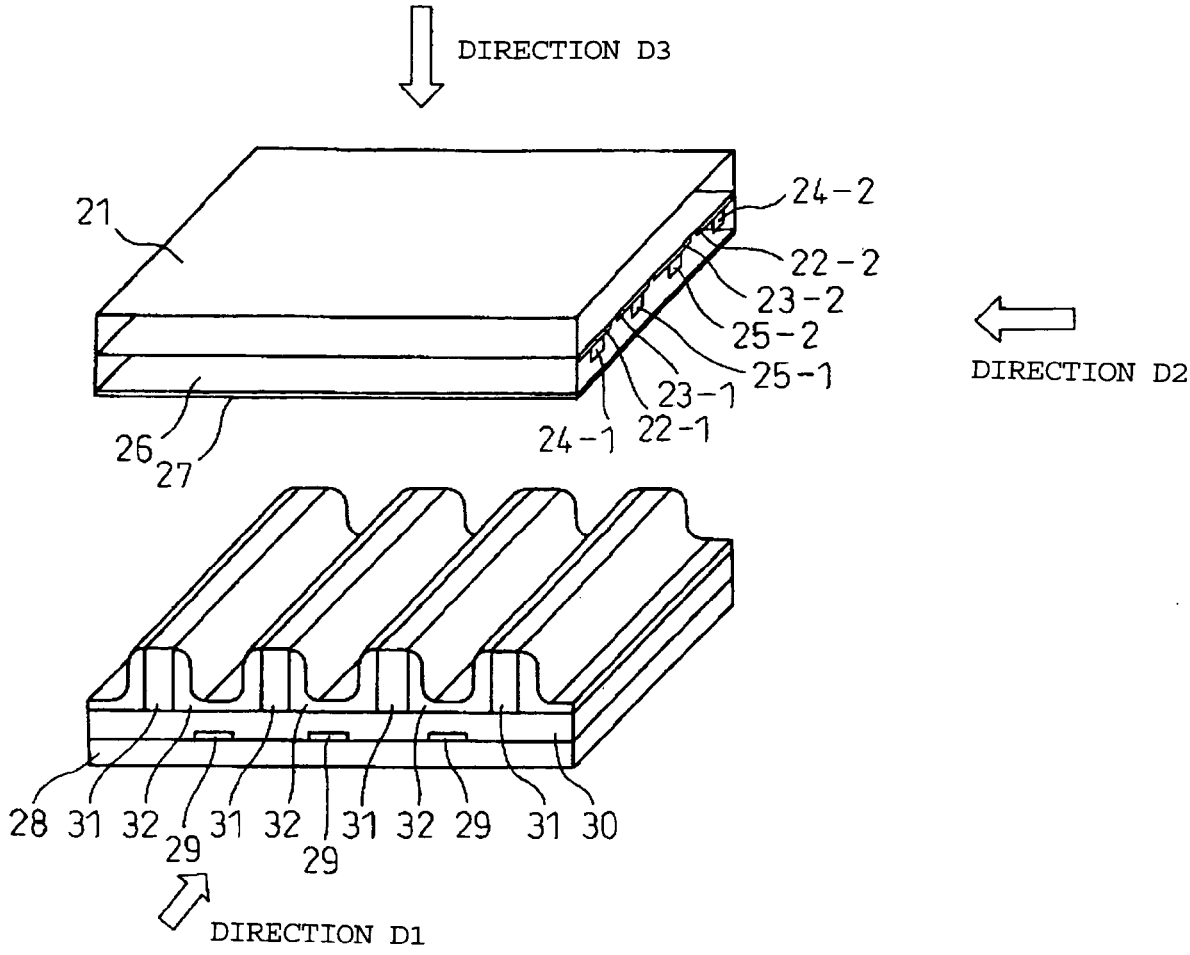
FIG. 1 is an exploded perspective view showing a part of a structure of a plasma display panel.
Figure 15:
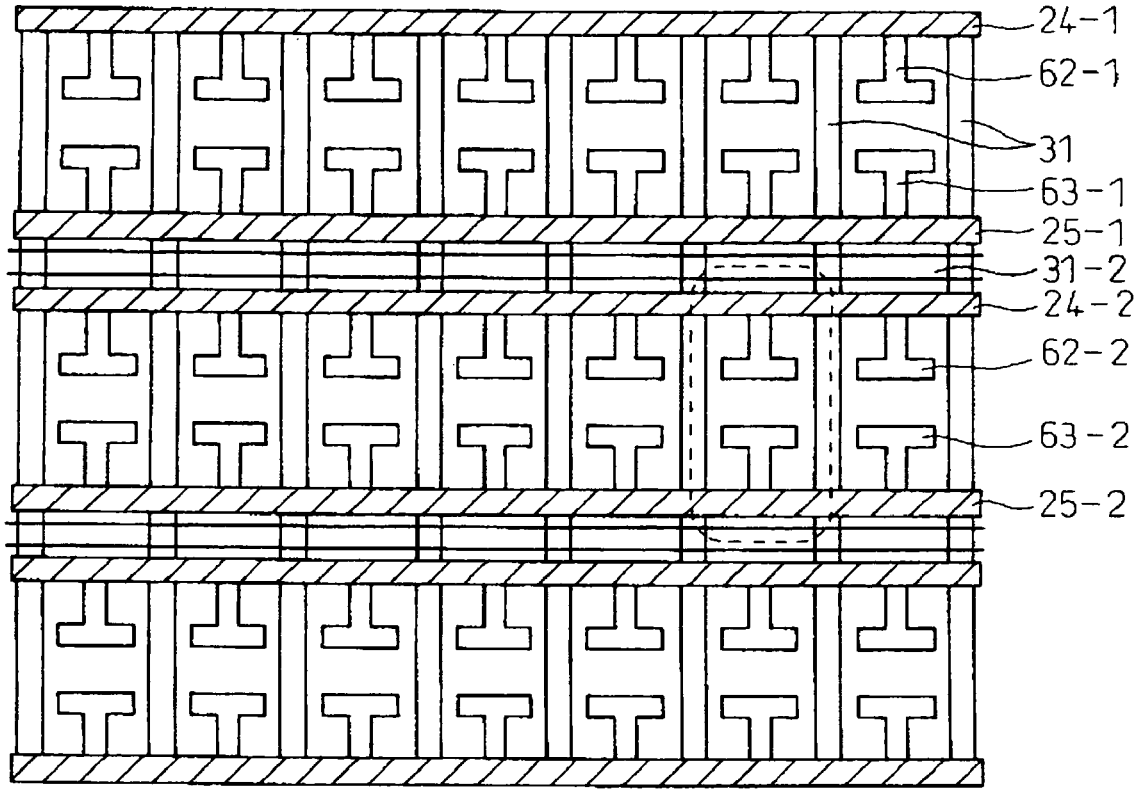
FIG. 15 is a plan view showing a modified example of the plasma display panel according to the present invention, which shows an electrode shape of the plasma display panel viewed in the direction D3 in the exploded perspective view of FIG. 1.

FIG. 15 is a plan view showing a modified example of the plasma display panel according to the present invention, which shows an electrode shape of the plasma display panel viewed in the direction D3 in the exploded perspective view of FIG. 1.

As shown in FIG. 15, the plasma display panel of this modified example is provided with barrier ribs 31-2 (also referred to as lateral barrier rib) extending in the row direction in addition to the barrier ribs 31 extending in the column direction. The lateral barrier rib is provided in order to prevent erroneous discharges in the gap on the opposite side of the discharge gap and to effectively use the region on the discharge gap side.

In the structure shown in FIG. 15, the potential distribution on the protection film surface is calculated while changing the thickness of the dielectric layer and the electrode shape. As a result, the result similar to that in the case where the barrier rib 31-2 is not present can be obtained. Therefore, the above-described relationship between the thickness of the dielectric layer and the electrode shape is established even when the barrier rib 31-2 is present.

Also, with respect to the structure of each cell surrounded by the barrier rib 31 and the barrier rib 31-2 extending in the row direction, even when the width between the adjacent barrier ribs 31 is formed to be narrower away from the center of the discharge gap in the column direction, the above described relationship between the thickness of the dielectric layer and the electrode shape is established.

Figure 16:
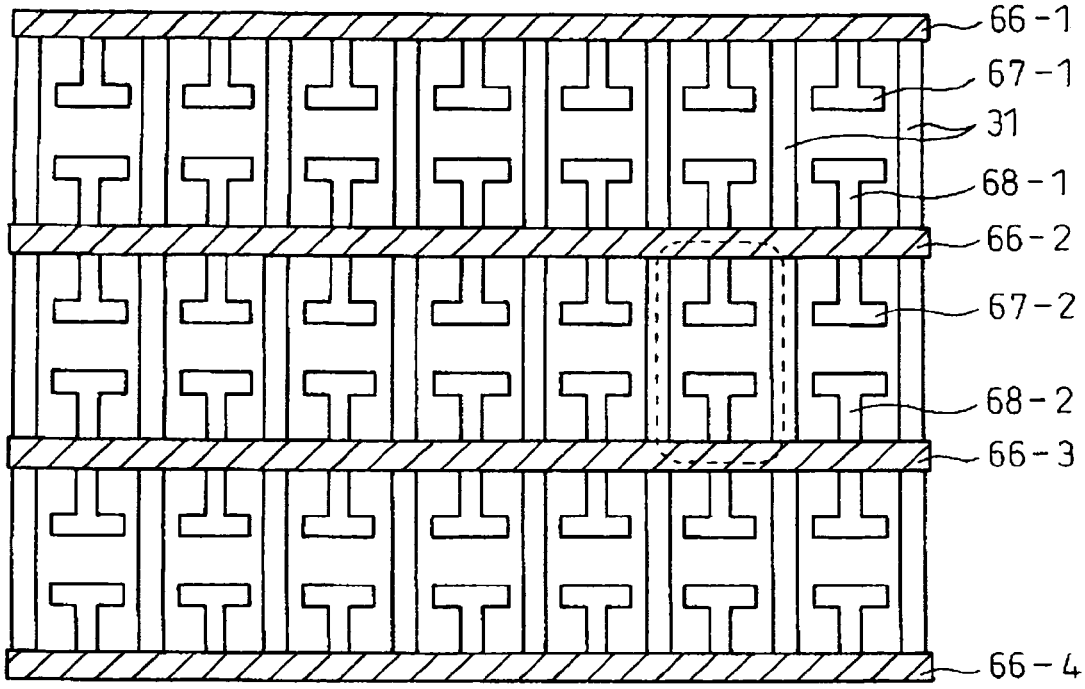
FIG. 16 is a plan view showing another modified example of the plasma display panel according to the present invention, which shows an electrode shape of the plasma display panel viewed in the direction D3 in the exploded perspective view of FIG. 1.

FIG. 16 shows another modified example of the plasma display panel according to the present invention, which is a plan view showing an electrode shape of the plasma display panel viewed in the direction D3 in the exploded perspective view of FIG. 1.

Furthermore, as shown in FIG. 16, the plasma display panel according to this modified example has a structure in which the X bus electrodes and the Y bus electrodes are used in common as bus electrodes 66-1, 66-2, . . . and pairs of projections (68-1 and 67-2, for example) extend in the column direction with sandwiching the bus electrodes 66-1, 66-2, . . . therebetween.

The potential distribution on the protection film surface is calculated while changing the thickness of the dielectric layer and the electrode shape in the structure shown in FIG. 16. As a result, even in the structure where the bus electrodes are used in common as shown in FIG. 16, the same result as in the structure where the X bus electrodes and the Y bus electrodes are separately used can be obtained. Therefore, even when the bus electrodes are used in common, the above-described relationship between the thickness of the dielectric layer and the electrode shape is established.

Although the T-shaped electrode is depicted in the modified examples shown in FIG. 15 and FIG. 16, a similar result can be obtained even when the trapezoidal electrode is used.

Figure 17:
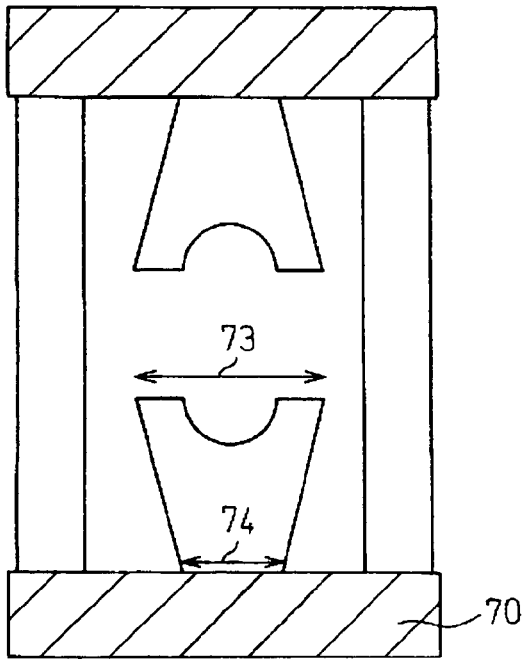
FIG. 17 is a diagram (1) showing another modified example of the display electrode shown in FIG. 12.
Figure 18:
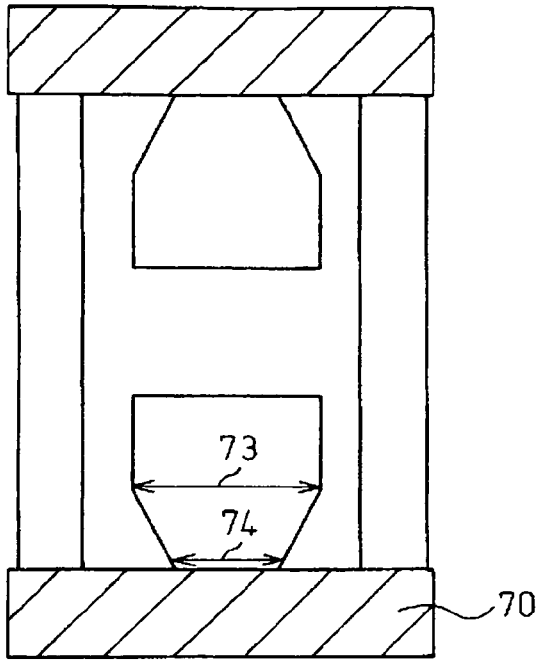
FIG. 18 is a diagram (2) showing another modified example of the display electrode shown in FIG. 12.
Figure 19:
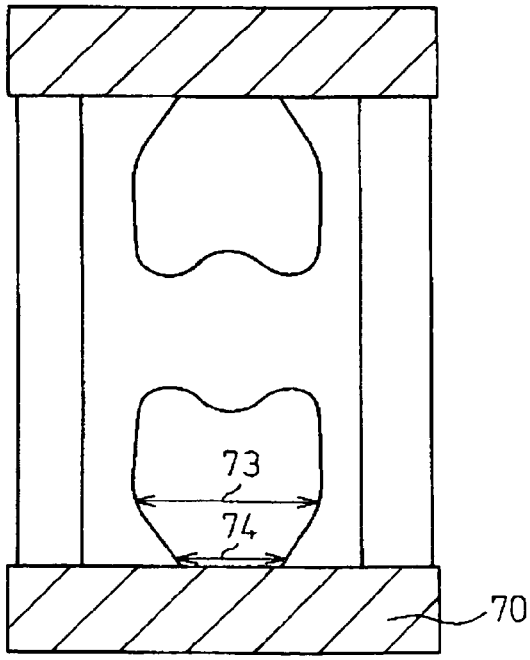
FIG. 19 is a diagram (3) showing another modified example of the display electrode shown in FIG. 12.

FIG. 17 to FIG. 19 are diagrams showing further modified examples of the display electrode shown in FIG. 12.

In the display electrode shown in FIG. 17, a part of the electrode is removed. More specifically, a part thereof near the discharge gap is removed, and the electrode has the substantially trapezoidal shape. The potential distribution on the protection film surface is also similar to that of the trapezoidal shape, and the relationship between the thickness of the dielectric layer and the electrode shape shown in FIG. 14 is established.

The display electrode shown in FIG. 18 has a shape in which a trapezoid and a rectangle (a ratio of upper base to lower base is 1) are combined and an area near the discharge gap is large, and its effect is similar to that of the trapezoidal one shown in FIG. 12. Note that, as a result of the examination of the sustain discharge voltage, the trapezoidal shape shown in FIG. 12 and the shape shown in FIG. 18 have the same discharge gap, and the relationship between the thickness of the dielectric layer and the electrode shape shown in FIG. 14 is established as long as they have the same area.

In the electrode shape shown in FIG. 19, edges of the electrode are smoothly connected. The shape obtained by smoothly connecting the edges of the electrode obtained by the combination of the shapes shown in FIG. 17 and FIG. 18 is shown as one example, and the relationship between the thickness of the dielectric layer and the electrode shape shown in FIG. 14 is established even when the edges of the electrode of any shape are smoothly connected in a curved manner.

Figure 20:
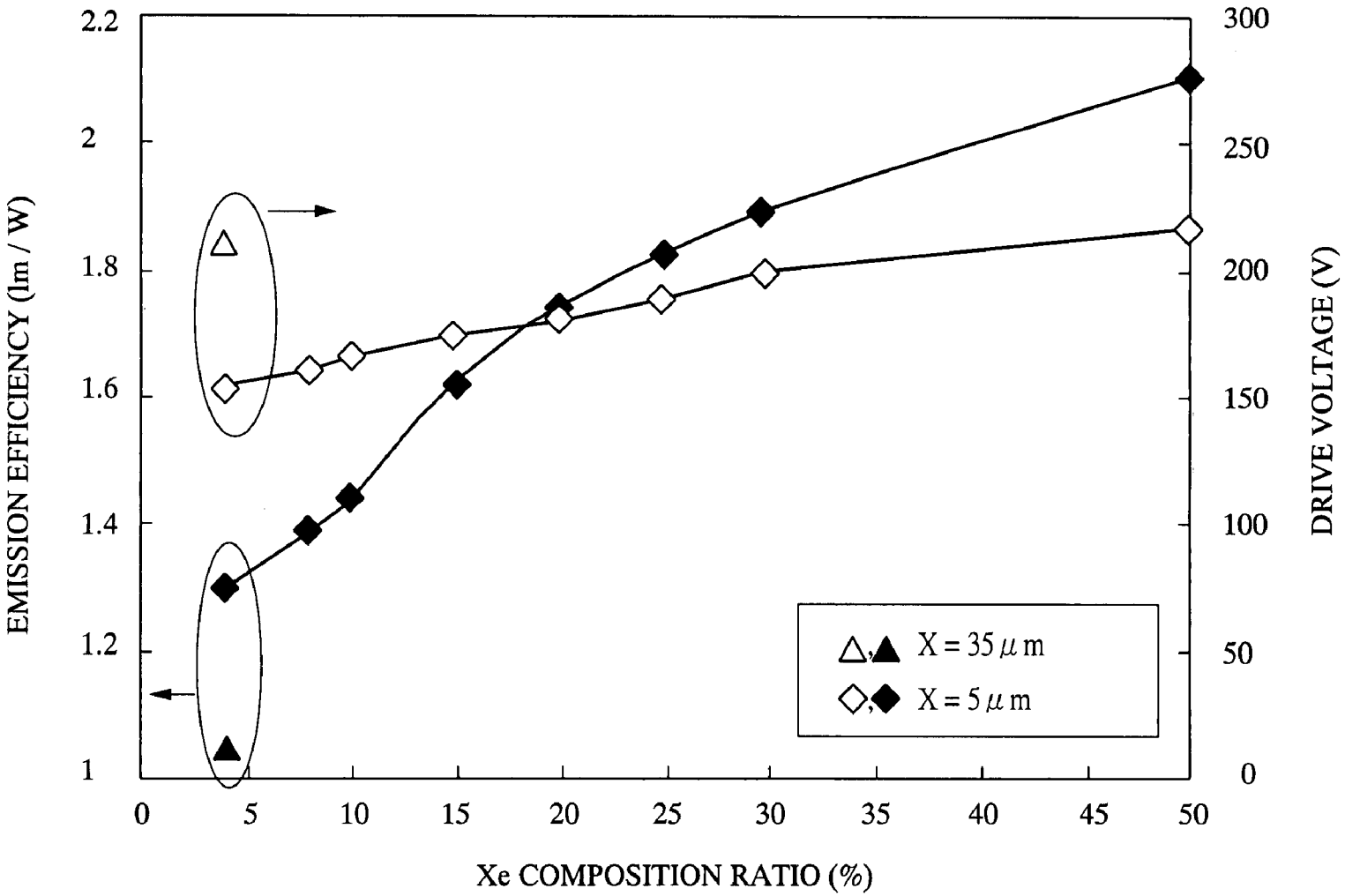
FIG. 20 is a diagram showing a result of the measurement in which a drive voltage and emission efficiency are measured as functions of Xe composition ratio in one embodiment of the plasma display panel according to the present invention.

FIG. 20 is a diagram showing a result of the measurement in which the drive voltage and the emission efficiency are measured as the functions of the composition ratio of Xe in one embodiment of the plasma display panel according to the present invention. Specifically, FIG. 20 shows a result of the measurement in which the drive voltage determined by the firing voltage and the sustain discharge voltage (midpoint between the approximate firing voltage and the sustain discharge voltage) and the emission efficiency when driven at the above-described drive voltage are measured while changing the Xe composition ratio (%) as the discharge gas, in the electrode having the projections with a shape of Y=1. The measurement is carried out under the conditions that the thickness of the dielectric layer, that is, X(μm) is 35 μm and 5 μm.

As shown in FIG. 20, for example, since the thickness X of the dielectric layer can be reduced from 35 μm to 5 μm by using the aforementioned $SiO_2$ film as the dielectric layer and the drive margin can be sufficiently secured by optimizing the electrode shape as described above, it can be seen that the drive voltage can be reduced by 60 V under the condition that the Xe composition ratio is 4% (60 kPa). It is clear that this effect is obtained by optimizing the thickness of the dielectric layer and the electrode shape as described above.

Here, the composition ratio in the discharge gas is defined and measured as follows. First, when a certain component in the discharge gas is #, the composition ratio of # is defined as:

$$\text{Composition ratio of } \# = N\#/Nt \quad (1)$$

In this case, N# is the number of # component particles (atoms, molecules) in the discharge gas in unit volume, and its unit is represented by, for example, $m^{-3}$. Similarly, Nt is the number of all particles (atoms, molecules) in the discharge gas in unit volume, and its unit is represented by, for example, $m^3$ The above definition can be expressed and measured as follows according to physical low. That is:

$$\text{Composition ratio of } \# = P\#/Pt \quad (2)$$

In this case, P# is a partial pressure of the # component gas in the discharge gas and Pt is the total pressure of the discharge gas. The partial pressure and the total pressure can be expressed by a unit of Pa. The total pressure can be measured by a pressure indicator, and the partial pressure and the total pressure of each component can be measured by, for example, analyzing the gas component with a mass analyzer.

As shown in FIG. 20, the emission efficiency is improved by 1.2 times since the drive voltage can be decreased when the Xe composition ratio is 4%. Further, it can be seen that when the Xe composition ratio is increased, the drive voltage increases and the emission efficiency also increases. When compared with the case where the Xe composition ratio is 4% and X=35 μm, the emission efficiency is almost doubled when the Xe composition ratio is 50% and X=5 μm.

With respect to the relationship between the increase in Xe composition ratio and the increase in drive voltage, when the Xe composition ratio is 50% and X=5 μm, driving can be performed at the same voltage as that under the conditions of the Xe composition ratio of 4% and X=35 μm. More specifically, by optimizing the thickness of the dielectric layer and the electrode shape, the decrease in drive voltage can be allocated to the increase of the Xe composition ratio. Consequently, the emission efficiency can be significantly increased even at the same drive voltage as the conventional one.

The above experiment is performed at 60 kPa, and Ne gas is filled as buffer gas in addition to the Xe gas as the discharge gas. Even when the pressure of the gas is changed from 40 hPa to 80 hPa and the buffer gas contains He, Kr, Ar or the like, the effect of the reduction of drive voltage can be obtained by the above-described optimization of the thickness of the dielectric layer and the electrode shape according to the aforementioned present invention, and the effect in which the emission efficiency is improved in accordance with the Xe composition ratio remains unchanged.

From a different viewpoint, it is clear that this suppresses the increase in the drive voltage and the emission efficiency can be increased while suppressing the increase in withstand voltage of the driver circuit, that is, the increase in production cost of the drive circuit. Also, the improvement in the emission efficiency, that is, the improvement in the discharge efficiency relative to the luminance leads to the increase in a degree of freedom of design and the improvement in luminance.

As described above, it is possible to provide a plasma display panel and plasma display device with high luminance and excellent brightness at low cost by the optimization of the thickness of the dielectric layer and the electrode shape under the condition of the Xe composition ratio from 4% to 50%.

Figure 21:
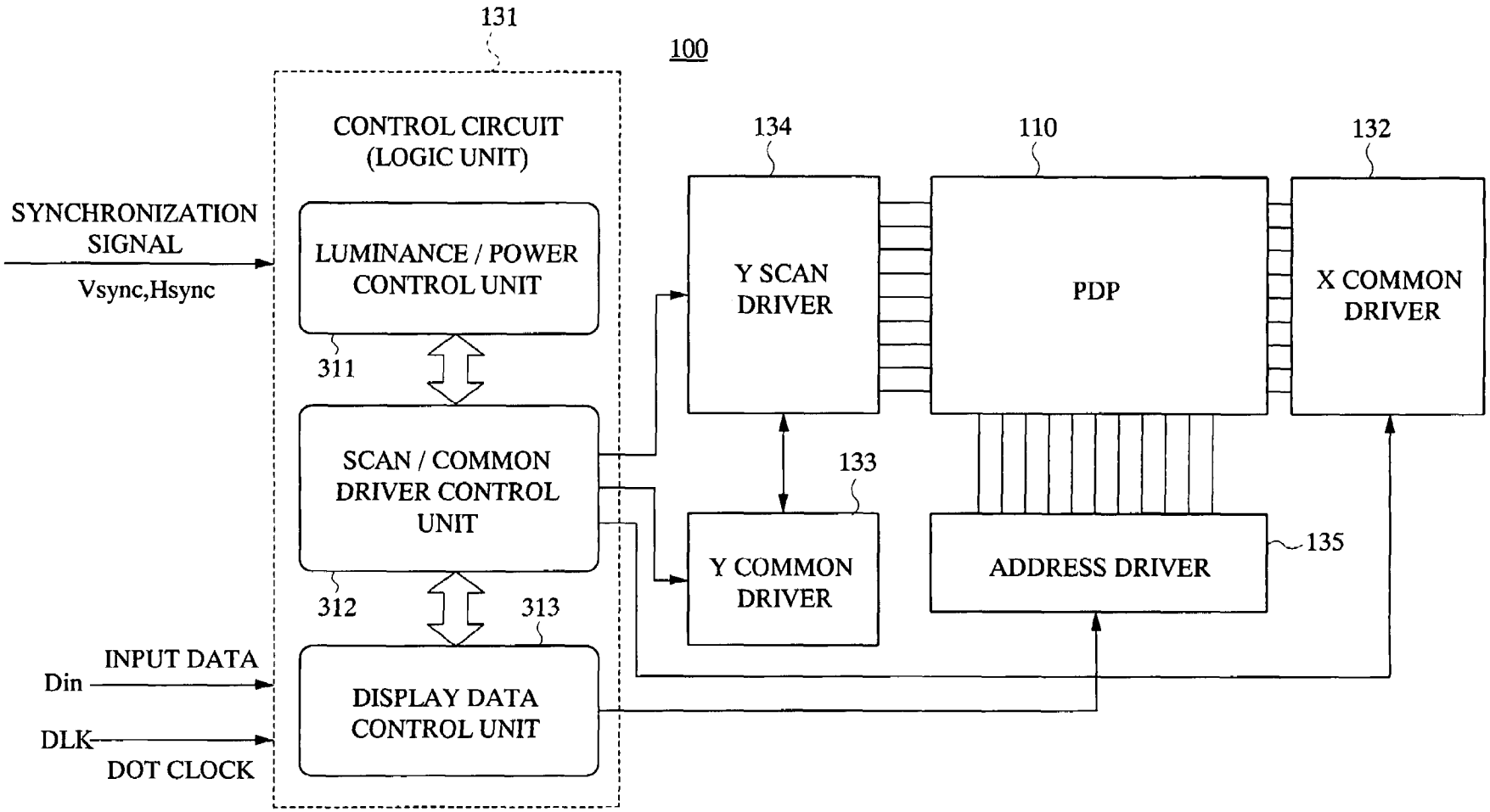
FIG. 21 is a block diagram schematically showing the entire structure of one example of a plasma display device according to the present invention.

FIG. 21 is a block diagram schematically showing the entire structure of one example of a plasma display device.

A plasma display device 100 comprises a PDP 110, an X common driver 132 for driving each cell in the PDP 110, a Y common driver 133, a Y scan driver 134, an address driver 135, and a control circuit (logic unit) 131 for controlling each driver. Input data Din as multilevel image data indicating luminance levels of three colors R, G and B from an external device such as TV tuner or computer, a dot clock CLK, and various synchronization signals (horizontal synchronization signal Hsync, vertical synchronization signal Vsync and the like) are inputted to the control circuit 131, and the control circuit 131 outputs the control signals suitable for the respective drivers 132 to 135 based on the input data Din, the dot clock CLK, and the various synchronization signals to perform the predetermined image display.

The control circuit 131 includes a luminance/power control unit 311 for controlling luminance and power consumption of the PDP 110, a scan/common driver control unit 312 for controlling the scanning of the Y electrodes via the Y scan driver 134 and controlling the sustain discharge in the display electrodes (between the X electrode and the Y electrode) via the X common driver 132 and the Y common driver 133, and a display data control unit 313 for controlling the data to be displayed on the PDP 110 via the address driver 135.

Note that the plasma display device shown in FIG. 21 is only an example, and it is needless to say that the present invention can be applied to other various plasma display devices.

Next, the present invention will be described in detail based on the relationship between the relative dielectric constant $\in r$ of a material which forms the dielectric layer and the ratio Z of an effective electrode area S1 to an effective discharge area S2 (=S1/S2) in the discharge cell.

Since the size of the discharge cell and the area of the electrode largely influence the luminance, the discharge current and the emission efficiency in the plasma display panel, the area in which discharge effectively expands (effective discharge area S2) and the area of the electrode (effective electrode area S1) in the discharge cell are important parameters when designing the panel.

Figure 4:
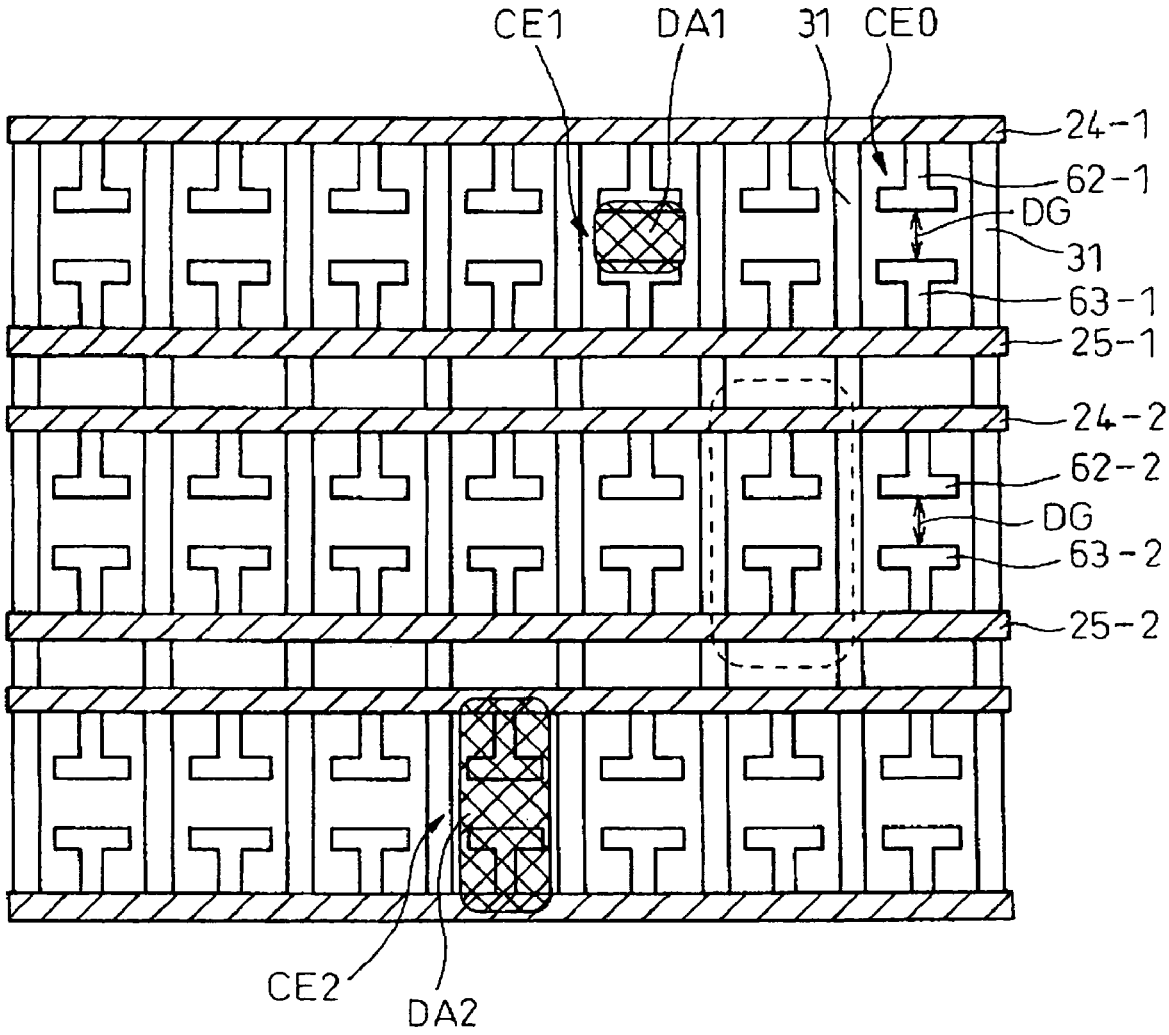
FIG. 4 is a plan view of the plasma display panel showing a modified example of the electrode shape shown in FIG. 3.
Figure 5:
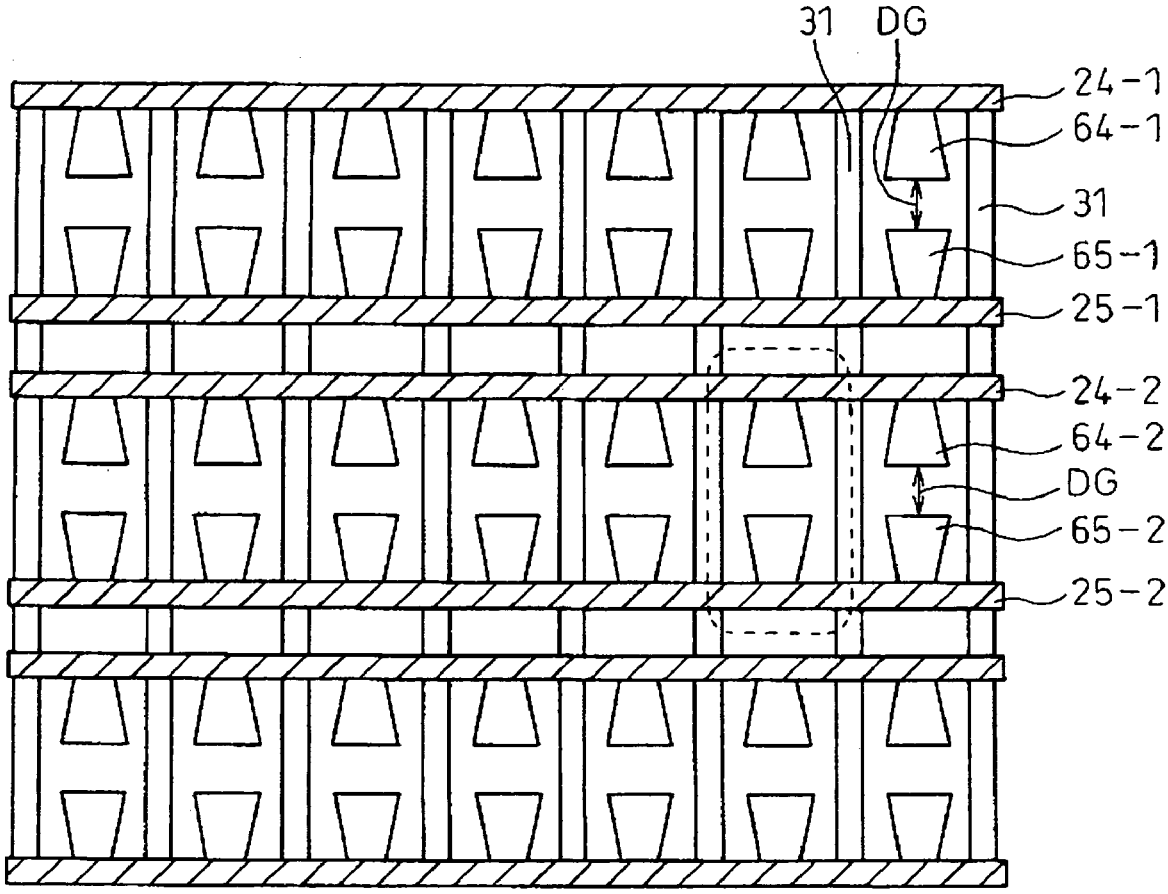
FIG. 5 is a plan view of the plasma display panel showing another modified example of the electrode shape shown in FIG. 3.
Figure 22A:
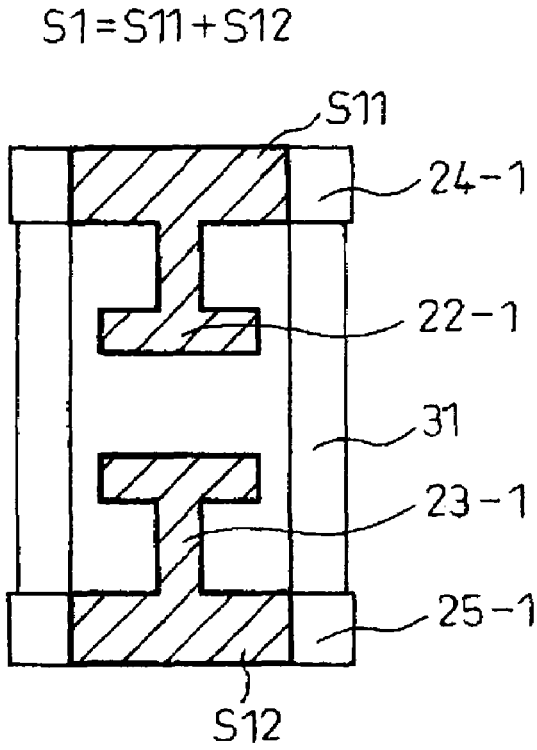
FIG. 22 is a diagram showing an effective discharge area and an effective electrode area in one discharge cell in the plasma display panel shown in FIG. 4.
Figure 22B:
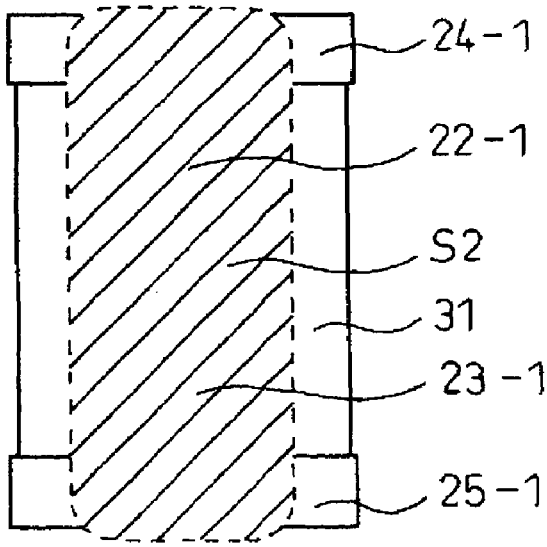

FIG. 22A and FIG. 22B are diagrams showing the effective discharge area S2 and the effective electrode area S1 in one discharge cell CE0 in the plasma display panel shown in FIG. 4.

First, as shown in FIG. 22A, for example, in the discharge cell CE0 having the T-shaped electrodes shown in FIG. 4, when viewed from the front of the panel, an area of a region where discharge effectively expands without being interrupted by the barrier rib 31 or the like and the electrodes are present is defined as the effective electrode area S1 (=S11+S12). In other words, the effective electrode area S1 is obtained by adding the areas of both electrodes on the X electrode side and the Y electrode side.

Further, as shown in FIG. 22B, for example, in the discharge cell CE0 having the T-shaped electrodes shown in FIG. 4, when viewed from the front of the panel, an area of a region where discharge is effectively generated without being interrupted by the barrier rib 31 or the like is defined as the effective discharge area S2.

Figure 23:
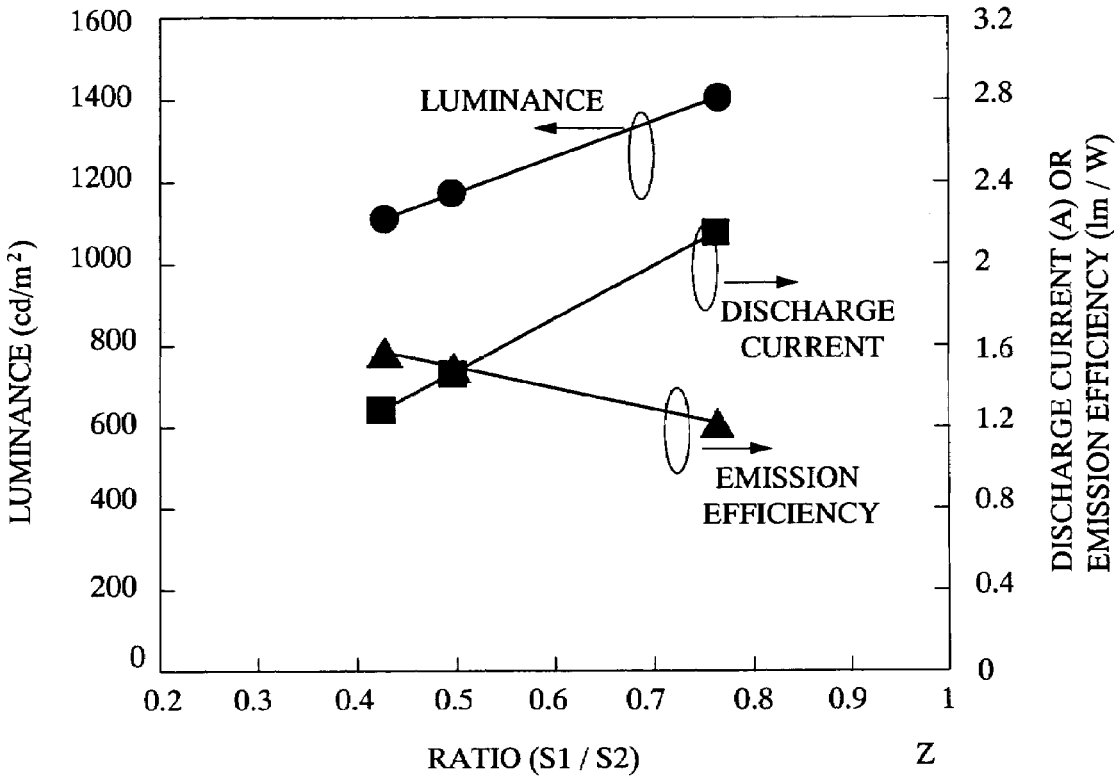
FIG. 23 is a diagram showing a measurement result of the luminance, discharge current and emission efficiency when a ratio of the effective electrode area to the effective discharge area is changed in the discharge cell of FIG. 22.

Here, FIG. 23 shows a result of the measurement in which the luminance, the discharge current and the emission efficiency are measured while changing the area of the electrodes 22-1 and 23-1, that is, while changing a ratio of the effective electrode area S1 to the effective discharge area S2 in FIG. 22A. Note that, in FIG. 23, low melting point glass (lead glass: relative dielectric constant $\in r$ is 12 to 14, for example) is used as the dielectric layer and the thickness of the dielectric layer is about 30 μm.

The measurement result shown in FIG. 23 corresponds to the case where sustain discharge is performed at a frequency of 60 kHz, and it shows almost the peak luminance, in which the luminance is designed to be 1000 cd/m$^2$ or higher. In order to manufacture a display with higher brightness, the peak luminance of at least 1000 cd/m$^2$ or higher is desired.

As can be seen from FIG. 23, the luminance increases as the ratio Z of the effective electrode area to the effective discharge area (=S1/S2) increases.

For example, if a dielectric layer having a low relative dielectric constant $\in r$ is formed by the plasma vapor deposition or the like, a problem of the luminance decrease occurs. In this case, when a vacuum dielectric constant ($8.8542 \cdot 10^{-12} \cdot C^2 \cdot N^{-1} \cdot m^{-2}$) is defined as $\in o$ and a dielectric constant indicating the characteristic of the dielectric layer is defined as $\in$, the relative dielectric constant $\in r$ is defined by $\in / \in o$. More specifically, since a dielectric capacity of the discharge cell made of the dielectric layer with a low relative dielectric constant is small, the discharge current flowing when discharge is generated is reduced and the luminance is decreased.

Therefore, it is necessary to increase the electrode area to improve the luminance as shown in FIG. 23. Actually, since the effective discharge area S2 influences the emission efficiency, the ratio Z of the effective electrode area S1 to the effective discharge area S2 is an important parameter.

Then, dielectric layers having a relative dielectric constant $\in r$ of 8.5 and 14 are formed. At this time, the discharge cells in which the ratio Z of the effective electrode area to the effective discharge area (=S1/S2) is changed to 0.77 and 0.43, respectively, are fabricated so that the dielectric capacity becomes constant. Consequently, the luminance in both measurements becomes identical.

Figure 24:
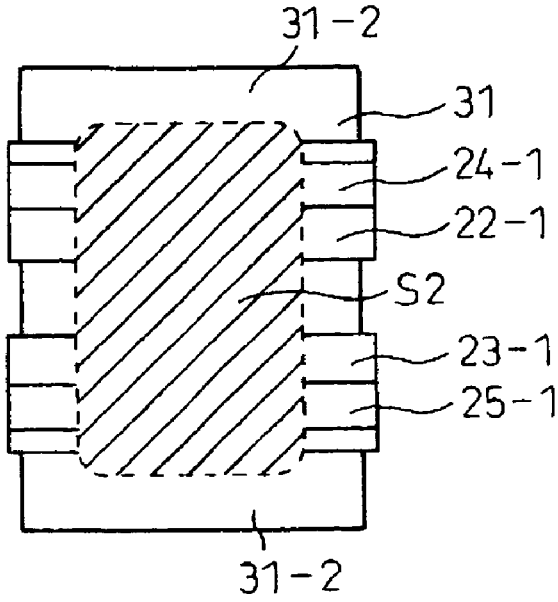
FIG. 24 is a diagram showing the effective discharge area in another example of a discharge cell different from that of FIG. 22.
Figure 25:
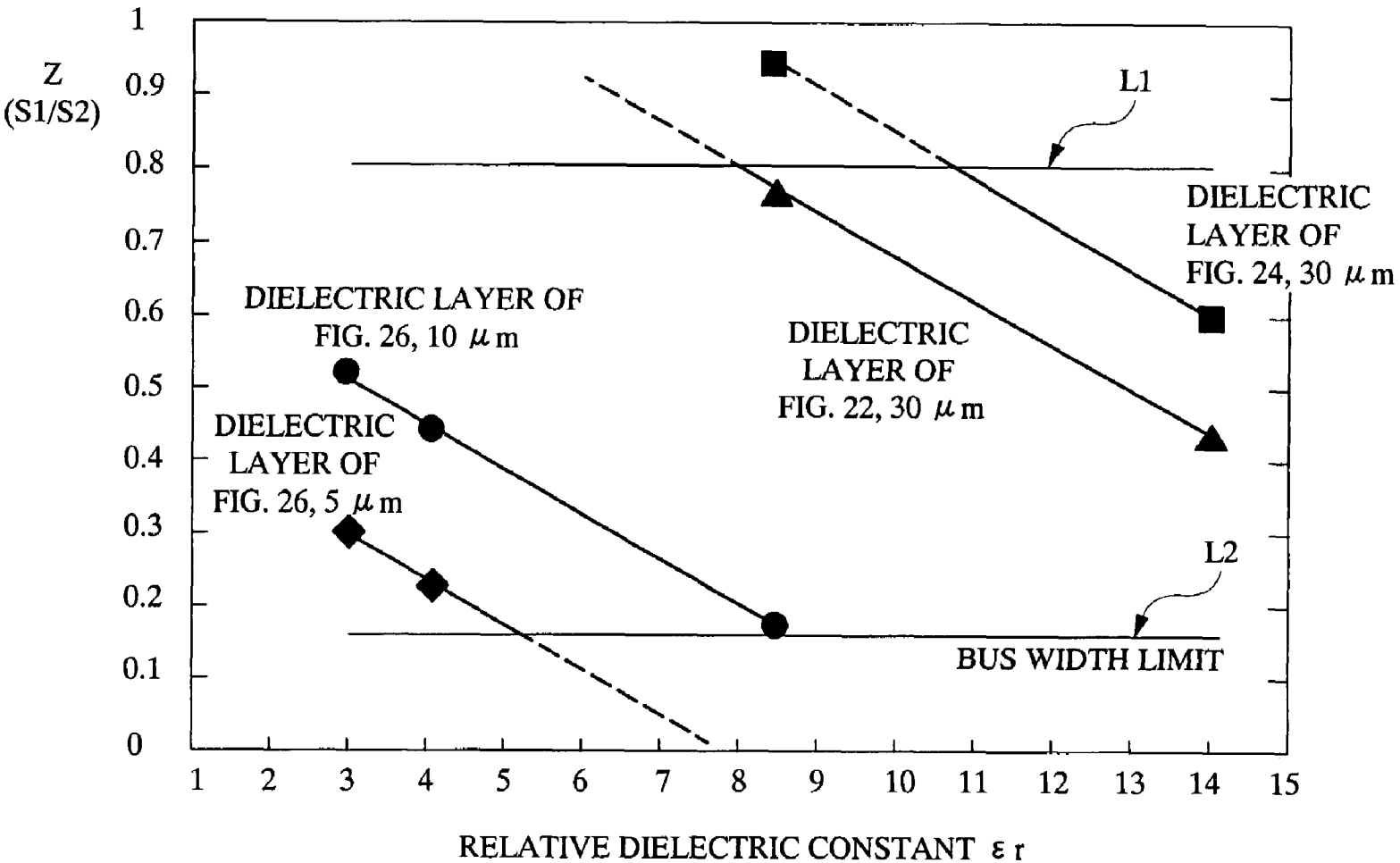
FIG. 25 is a diagram showing a relationship between a relative dielectric constant of a dielectric layer and a ratio of the effective electrode area to the effective discharge area in each discharge cell.

FIG. 24 is a diagram showing the effective discharge area in another example of a discharge cell different from that of FIG. 22, and FIG. 25 is a diagram showing a relationship between the relative dielectric constant of the dielectric layer and the ratio of the effective electrode area to the effective discharge area in each discharge cell.

The result of the measurement using the discharge cell having the structure shown in FIG. 24 will be described. The relative dielectric constant $\in r$ of the dielectric layer is about 14, and the thickness X of the dielectric layer is about 30 μm. The measurement is carried out while setting the ratio Z of the effective electrode area to the effective discharge area to 0.6 and 0.94, respectively.

In FIG. 24, the ratio Z of the effective electrode area to the effective discharge area is large and the luminance increases, but the emission efficiency decreases. The emission efficiency is 1.31 m/W when the ratio Z of the effective electrode area to the effective discharge area is 0.6, and if the emission efficiency is lower than 1.31 m/W, it causes the degradation in performance.

The dielectric layers having a relative dielectric constant $\in r$ of 8.5 and 14 are fabricated. At this time, the ratio Z of the effective electrode area to the effective discharge area is changed to 0.56 and 0.94, respectively, so that the dielectric capacity becomes constant. As a result, the luminance of both cells becomes identical, but a discharge slit is extremely narrow in the discharge cell having the ratio Z of the effective electrode area to the effective discharge area of 0.94, and consequently, the discharge becomes unstable. As a result of detailed examination, it is seen that stable driving cannot be performed when the ratio Z of the effective electrode area to the effective discharge area is 0.80 or higher.

Furthermore, if the emission efficiency when the ratio Z of the effective electrode area to the effective discharge area is 0.6 is lower than 1.31 m/W, the performance is degraded as described above. Therefore, the value has to be below the line L1 in FIG. 25, which represents the dielectric layer of FIG. 24.

Figure 26:
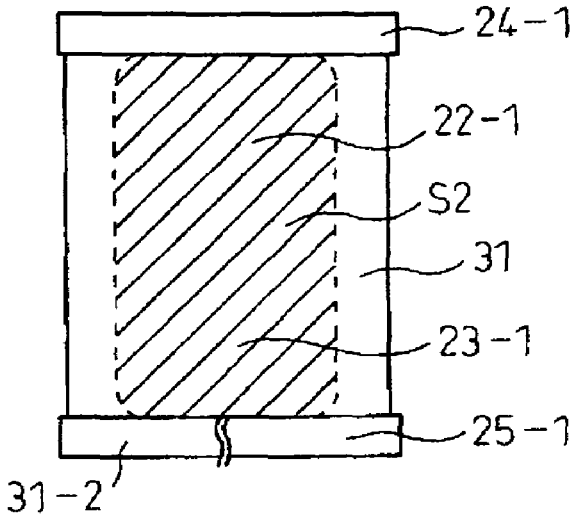
FIG. 26 is a diagram showing the effective discharge area in still another example of a discharge cell different from that of FIG. 22.

FIG. 26 is a diagram showing the effective discharge area in still another example of a discharge cell different from that of FIG. 22, in which the dielectric layers having the relative dielectric constant $\in r$ of 3, 4.1 and 8.5, respectively, are formed by plasma vapor deposition or the like. The thickness X of the dielectric layer is 10 μm. The measurement is carried out while setting the ratio Z of the effective electrode area to the effective discharge area to 0.51, 0.43, and 0.16, respectively.

The dielectric layer having a dielectric constant $\in r$ of 3 is a low-density film in which bubbles are formed, which is obtained by forming a dielectric layer (film) at high speed by the plasma vapor deposition. There is a merit that the thickness of the dielectric layer can be reduced when the dielectric constant is decreased. Accordingly, the luminance is linear and constant as shown in FIG. 25.

Furthermore, a discharge cell with the cell structure of FIG. 26 having the dielectric thickness of 5 μm is fabricated as shown in FIG. 25, and the relative dielectric constant $\in r$ is set to 3 and 4.1. Then, the measurement is carried out while setting the ratio Z of the effective electrode area to the effective discharge area to 0.29 and 0.215. As a result, it is confirmed that the luminance is constant.

If the ratio Z of the effective electrode area to the effective discharge area is further reduced, only the bus electrodes must be used by removing the transparent electrodes, and further the bus electrode cannot be designed to be 50 μm or smaller due to the manufacturing restriction. Because of this requirement, the lower limit of the ratio of the effective electrode area to the effective discharge area is 0.15 (see line L2 in FIG. 25).

Also, if the thickness of the dielectric layer is reduced to 5 μm or smaller, the problem that the insulation breakdown occurs is caused. Therefore, the limit of the thickness of the dielectric layer is 5 μm as shown in FIG. 25.

Figure 27:
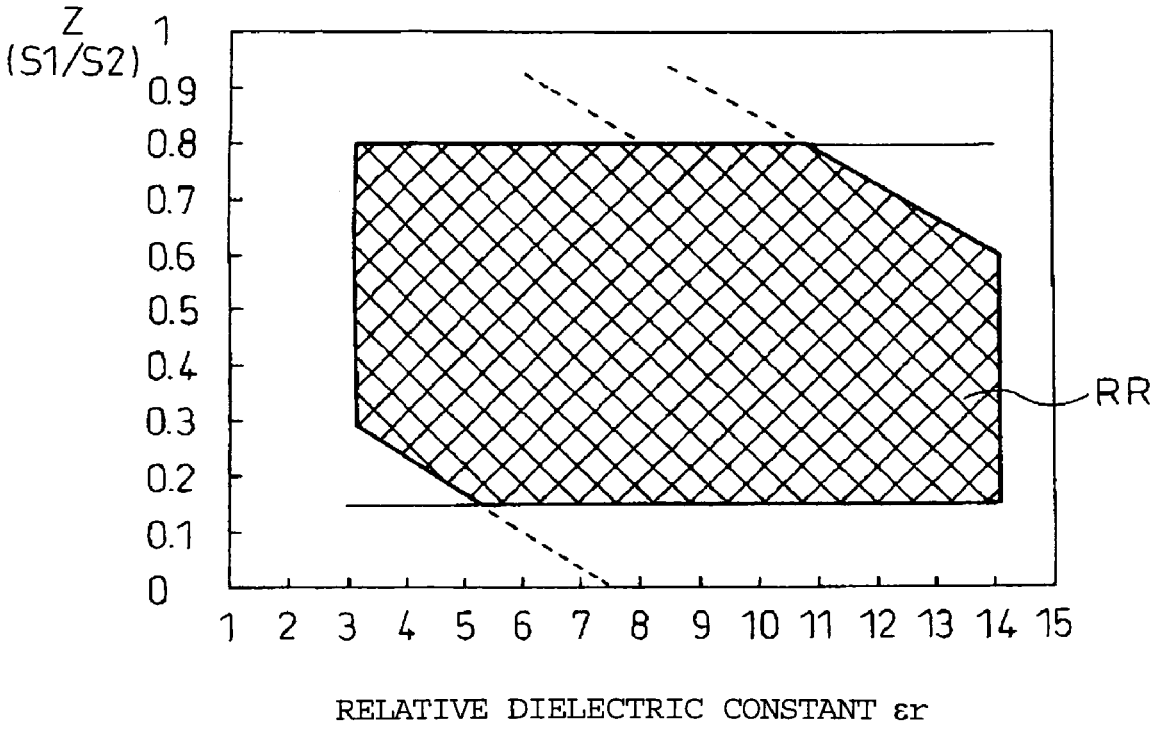
FIG. 27 is a diagram showing the condition of the relative dielectric constant of the dielectric layer and the ratio of the effective electrode area to the effective discharge area required in the plasma display panel to which the present invention is applied.

In conclusion, it is seen that a range in which the relative dielectric constant $\in r$ and the ratio Z of the effective electrode area to the effective discharge area are effective corresponds to a cross-hatched region RR in FIG. 27, and the plasma display panel capable of being stably driven with high luminance and high emission efficiency can be realized when this condition is satisfied.

FIG. 27 is a diagram showing the condition of the relative dielectric constant of the dielectric layer and the ratio of the effective electrode area to the effective discharge area required in the plasma display panel to which the present invention is applied.

Figure 2:
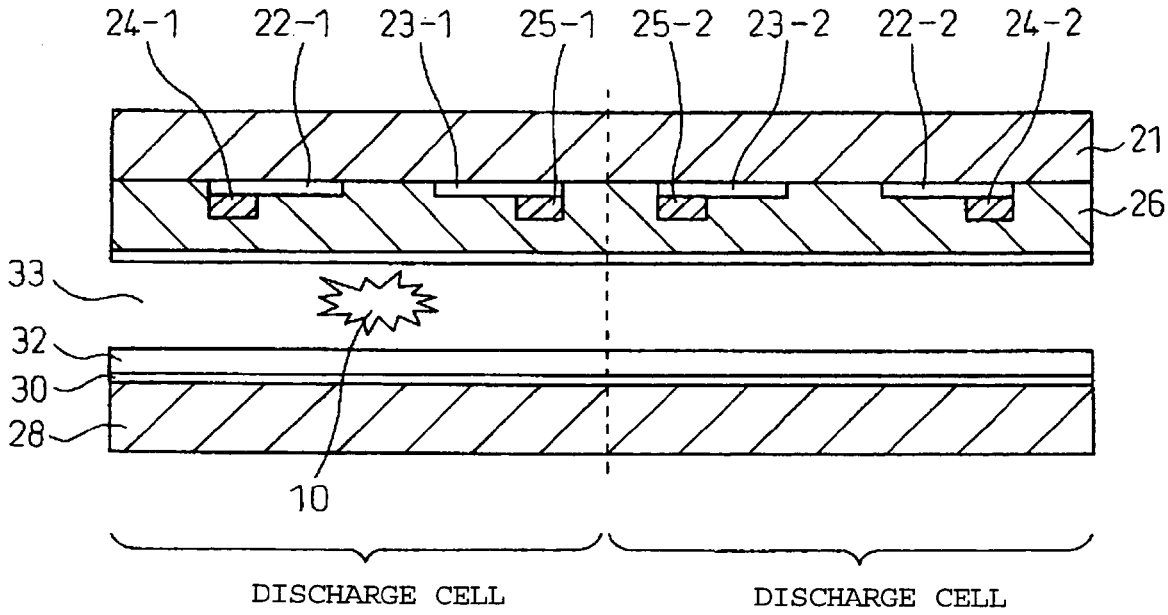
FIG. 2 is a cross-sectional view of the principal part of the plasma display panel viewed in the direction D2 in the exploded perspective view of FIG. 1.
Figure 3:
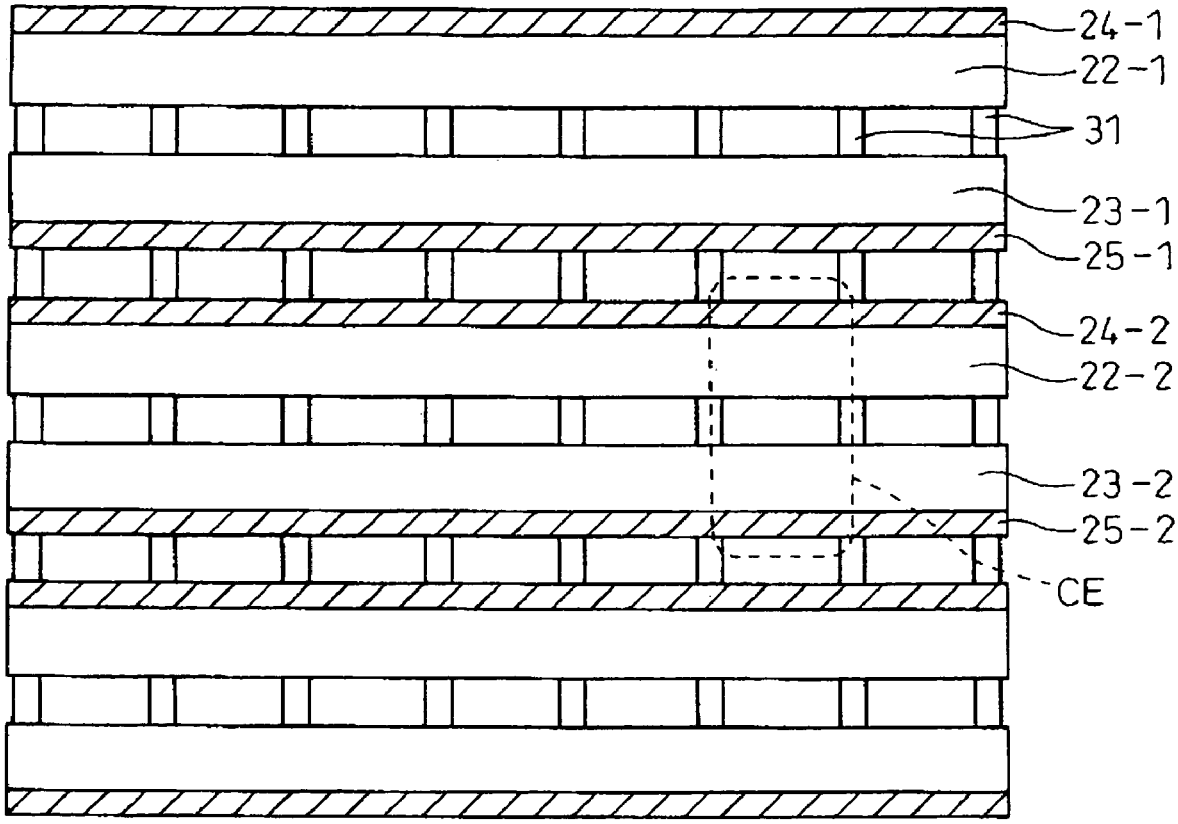
FIG. 3 is a plan view of the plasma display panel showing one example of an electrode shape viewed in a direction D3 in the exploded perspective view of FIG. 1.

Therefore, when the ratio of the effective electrode area S1 to the effective discharge area S2 is defined as Z (=S1/S2) and the relative dielectric constant of the dielectric which forms the dielectric layer (reference numeral 26 in FIG. 2) is defined as $\in r$, if $3 \leqq \in r \leqq 14$, $0.15 \leqq Z \leqq 0.8$ and $-0.0614 \cdot \in r + 0.47 \leqq Z \leqq -0.0614 \cdot \in r + 1.46$ are satisfied, the plasma display panel capable of being stably driven with high luminance and high emission efficiency can be realized.

Note that the type of the discharge cell is not limited to those shown in FIG. 22, FIG. 24 and FIG. 26. As long as the effective discharge area S2 and the effective electrode area S1 can be defined, the plasma display panel capable of being stably driven with high luminance and high emission efficiency can be obtained from any discharge cell having an arbitrary shape (for example, hexagonal discharge cell) by applying the above-described conditions thereto.

In the foregoing, for example, since $SiO_2$ (relative dielectric constant $\in r$ is 3 to 5) is known as a dielectric whose relative dielectric constant $\in r$ is 4, the $SiO_2$ film is used to form the dielectric layer 26, and the display electrode having a predetermined area can be defined from the ratio Z of the effective electrode area to the effective discharge area based on the above-described conditions. In this manner, when the $SiO_2$ film is used as the dielectric, it is possible to reduce the thickness X of the dielectric layer as described above in detail. Therefore, the plasma display panel capable of sufficiently securing the drive margin and being stably driven at a low voltage can be realized. Further, it is also possible to manufacture the plasma display panel which is free of lead and does not contaminate the environments unlike a conventional one using lead glass as the dielectric layer.

The present invention can be applied to various plasma display panels and plasma display devices including a three-electrode surface discharge plasma display panel, and the plasma display device is utilized as an image display device for a personal computer or work station, a flat type wall-hanging TV, or a device for displaying advertisements or information.

What is claimed is:

1. A plasma display panel comprising at least display electrodes, a dielectric layer covering the display electrodes, barrier ribs, and discharge spaces, in which discharge gas is filled in the discharge spaces to form a plurality of discharge cells, wherein, in each of said discharge cells, said display electrode has a projection extending in a column direction from an electrode body extending in a row direction, and the projection forms a discharge gap together with an adjacent paired projection of the other display electrode, in each of the discharge cells, when viewed from a front of said plasma display panel, an area of a region where discharge effectively expands is defined as an effective discharge area, in each of said discharge cells, an area of a region where discharge effectively expands and electrodes are present is defined as an effective electrode area, and when a ratio of said effective electrode area to said effective discharge area is assumed as Z and a relative dielectric constant of said dielectric layer is assumed as $\in r$, $3 \leqq \in r \leqq 14$, $0.15 \leqq Z \leqq 0.8$ and $-0.0614 \cdot \in r + 0.47 \leqq Z \leqq -0.0614 \cdot \in r + 1.46$ are satisfied.

2. A plasma display device comprising: the plasma display panel according to claim 1; drivers for driving each of said discharge cells of the plasma display panel; and a control circuit for controlling the drivers.

* * * * *